US010670237B2

(12) United States Patent
Brlansky et al.

(10) Patent No.: US 10,670,237 B2
(45) Date of Patent: Jun. 2, 2020

(54) MODULAR LIGHT FIXTURE FRAMES AND HOUSINGS

(71) Applicant: Eaton Intelligent Power Limited, Dublin (IE)

(72) Inventors: John T. Brlansky, Denver, CO (US); Alexander Ross, Aurora, CO (US); John Leon, Parker, CO (US); Sohana Arni, Aurora, CO (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/974,140

(22) Filed: May 8, 2018

(65) Prior Publication Data

US 2018/0320863 A1 Nov. 8, 2018

Related U.S. Application Data

(60) Provisional application No. 62/502,891, filed on May 8, 2017.

(51) Int. Cl.

| | |
|---|---|
| ***F21V 15/01*** | (2006.01) |
| ***F21V 17/00*** | (2006.01) |
| ***F21V 23/00*** | (2015.01) |
| ***F21V 17/16*** | (2006.01) |
| *F21Y 115/10* | (2016.01) |

(52) U.S. Cl.

CPC ..... *F21V 15/012* (2013.01); *F21V 17/002* (2013.01); *F21V 17/166* (2013.01); *F21V 23/001* (2013.01); *F21Y 2115/10* (2016.08)

(58) Field of Classification Search

CPC ..... F21V 23/06; F21V 21/005; F21V 21/35; F21V 21/30

USPC ..... 362/368

See application file for complete search history.

(56) References Cited

U.S. PATENT DOCUMENTS

| | | | | |
|---|---|---|---|---|
| 2003/0142499 A1* | 7/2003 | Chiu | F21S 2/005 | 362/368 |
| 2005/0007780 A1* | 1/2005 | Feuerborn | F21S 2/005 | 362/257 |

* cited by examiner

*Primary Examiner* — William J Carter

(74) *Attorney, Agent, or Firm* — King & Spalding LLP

(57) ABSTRACT

A frame for a light fixture can include multiple detachably coupled components, where each of the detachably coupled components includes a channel inside of which at least one electrical conductor is disposed, and where at least one of the detachably coupled components includes at least one light module assembly coupling feature that is configured to couple to at least one light module assembly.

18 Claims, 21 Drawing Sheets

MODULAR LIGHT FIXTURE FRAMES AND HOUSINGS

TECHNICAL FIELD

This application claims priority under 35 U.S.C. § 119 to U.S. Provisional Patent Application Ser. No. 62/502,891, titled "Modular Light Fixture Frames and Housings" and filed on May 8, 2017, the entire contents of which are hereby incorporated herein by reference.

TECHNICAL FIELD

Embodiments described herein relate generally to light fixtures, and more particularly to systems, methods, and devices for modular frames and housings for light fixtures.

BACKGROUND

Light fixtures can have a number of different shapes, sizes, configurations, light sources. Frequently, the ability to adjust one or more of these features of a light fixture is limited, which in turn limits the flexibility that a user has with those light fixtures. When a light fixture gives a user the ability to adjust a feature, those adjustments can only be done with difficulty.

SUMMARY

In general, in one aspect, the disclosure relates to a frame for a light fixture. The frame can include multiple detachably coupled components, where each component includes a channel inside of which at least one electrical conductor is disposed, and where at least one component includes at least one light module assembly coupling feature that is configured to couple to at least one light module assembly.

In another aspect, the disclosure can generally relate to a light module assembly that includes a housing. The housing of the light module assembly can include a housing body that encloses at least a portion of the light module. The housing of the light module assembly can also include at least one first frame coupling feature disposed on the housing body, where the at least one first frame coupling feature is configured to couple to a frame, where the at least one first frame coupling feature is further configured to receive a means of electrical signal conveyance from the frame.

These and other aspects, objects, features, and embodiments will be apparent from the following description and the appended claims.

BRIEF DESCRIPTION OF THE DRAWINGS

The drawings illustrate only example embodiments of modular light fixture frames and housings and are therefore not to be considered limiting of its scope, as modular light fixture frames and housings may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1:
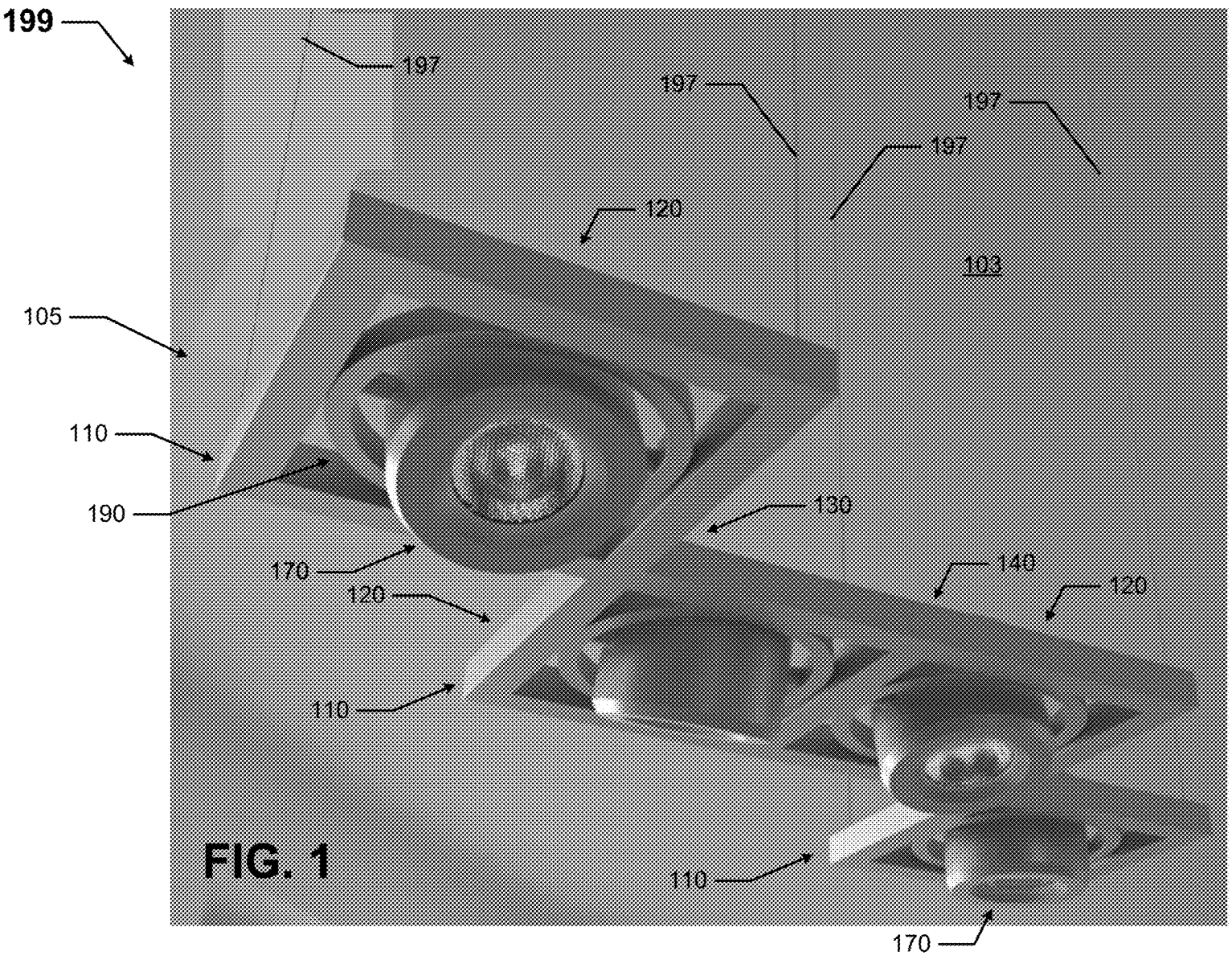
FIG. 1 shows a light fixture assembly in accordance with certain example embodiments.

The example embodiments discussed herein are directed to systems, methods, and devices for modular light fixture frames and housings. While example embodiments of modular frames are described herein as being used with light fixtures, such modular frames can alternatively be used with any of a number of other devices (or components thereof), including but not limited to speakers, sensors, art work (e.g., tiles, plates), and glass.

Example embodiments can be used with light fixtures located in any environment (e.g., indoor, outdoor, hazardous, non-hazardous, high humidity, low temperature, corrosive, sterile, high vibration). Further, light fixtures described herein can use one or more of a number of different types of light sources, including but not limited to light-emitting diode (LED) light sources, organic LEDs, fluorescent light sources, organic LED light sources, incandescent light sources, and halogen light sources. Therefore, light fixtures described herein, even in hazardous locations, should not be considered limited to a particular type of light source. When a light fixture uses LED light sources, those LED light sources can include any type of LED technology, including, but not limited to, chip on board (COB) and discrete die.

A user may be any person that interacts with a light fixture. Examples of a user may include, but are not limited to, an engineer, an electrician, an instrumentation and controls technician, a mechanic, an operator, a consultant, a contractor, an asset, a network manager, and a manufacturer's representative. Example frames and housings (including components thereof) described herein can be made of one or more of a number of materials, including but not limited to thermoplastic, copper, aluminum, rubber, stainless steel, and ceramic.

In certain example embodiments, light fixtures having example housings and modular frames are subject to meeting certain standards and/or requirements. For example, the National Electric Code (NEC), the National Electrical Manufacturers Association (NEMA), the International Electrotechnical Commission (IEC), the Federal Communication Commission (FCC), and the Institute of Electrical and Electronics Engineers (IEEE) set standards as to electrical enclosures (e.g., light fixtures), wiring, and electrical connections. As another example, Underwriters Laboratories (UL) sets various standards for light fixtures, including standards for heat dissipation. Use of example embodiments described herein meet (and/or allow a corresponding device to meet) such standards when required. In some (e.g., PV solar) applications, additional standards particular to that application may be met by the examples described herein.

Any light fixtures, or components thereof (e.g., example housings and frames), described herein can be made from a single piece (e.g., as from a mold, injection mold, die cast, 3-D printing process, extrusion process, stamping process, or other prototype methods). In addition, or in the alternative, a light fixture (or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, tabs, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling.

A coupling feature (including a complementary coupling feature) as described herein can allow one or more components and/or portions of an example heat sink or other component of a light fixture to become coupled, directly or indirectly, to another portion of the example frame, housing, and/or other component of a light fixture. A coupling feature can include, but is not limited to, a snap, a clamp, a portion of a hinge, an aperture, a recessed area, a protrusion, a slot, a spring clip, a tab, a detent, and mating threads. One portion of an example frame and/or housing can be coupled to another component of a light fixture by the direct use of one or more coupling features.

In addition, or in the alternative, a portion of an example frame and/or housing can be coupled to another component of a light fixture using one or more independent devices that interact with one or more coupling features disposed on a component of the frame and/or housing. Examples of such devices can include, but are not limited to, a pin, a hinge, a fastening device (e.g., a bolt, a screw, a rivet), epoxy, glue, adhesive, tape, and a spring. One coupling feature described herein can be the same as, or different than, one or more other coupling features described herein. A complementary coupling feature (also sometimes called a corresponding coupling feature) as described herein can be a coupling feature that mechanically couples, directly or indirectly, with another coupling feature.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three or four digit number and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of housings and modular frames used in light fixtures will be described more fully hereinafter with reference to the accompanying drawings, in which example embodiments of housings and modular frames used in light fixtures are shown. Housings and modular frames used in light fixtures may, however, be embodied in many different forms and should not be construed as limited to the example embodiments set forth herein. Rather, these example embodiments are provided so that this disclosure will be thorough and complete, and will fully convey the scope of housings and modular frames used in light fixtures to those or ordinary skill in the art. Like, but not necessarily the same, elements (also sometimes called components) in the various figures are denoted by like reference numerals for consistency.

Terms such as "first", "second", "top", "bottom", "side", "front", "distal", "proximal", and "within" are used merely to distinguish one component (or part of a component or state of a component) from another. Such terms are not meant to denote a preference or a particular orientation, and are not meant to limit embodiments of housings and modular frames used in light fixtures. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a bottom-side perspective view of a light fixture assembly 199 in accordance with certain example embodiments. The light fixture assembly 199 of FIG. 1 includes a light fixture 100 and a number of support members 197. The support members 197 couple to the frame 105 of the light fixture 100 and hold the light fixture in a relative position in a volume of space 103. For example, in this case, the support member 197 are also coupled to a ceiling, thereby suspending the light fixture 100 in the volume of space 103. One or more of the support members 197 can also be used to facilitate the transfer of electrical signals (e.g., power, control, data) between the light fixture 100 and one or more other components (e.g., power supply, controller, user device) in a lighting system.

While not show in this example, in some example embodiments, a power supply (e.g., a LED driver, a ballast) can be disposed inside of and/or atop the frame 105. In such a case, one or more of the support members 197 can be used to transmit power from a power source to the power supply of the light fixture 100. Alternatively, such a power supply of the light fixture 100 can be a source of power (e.g., a battery, a PV solar generation unit, a supercapacitor) onto itself. In addition, or in the alternative, while not shown in this example, a controller can be disposed within and/or atop the frame 105. In such a case, the controller can be used to control (e.g., turn on, turn off, dim, increase light output) one or more of the light modules 170 of the light fixture 100.

The example frame 105 of the light fixture 100 is modular. The example frame 105 can be made up of a number of different modular components that are mechanically coupled to each other. For example, as shown in FIG. 1, the components of the frame 105 can include one or more corner junctions 110, one or more T junctions 140, one or more cross junctions 130, and one or more linear sections 120. While not shown herein, a component of the frame 105 can have any of a number of other shapes and/or configurations, including but not limited to a tri junction (equidistant, isosceles), a curved section, a sawtooth section, and a S-shaped section.

In addition, or in the alternative, the components of the frame 105 shown herein can vary. For example, while the cross junctions 130 of FIG. 1 have adjacent arms that are perpendicular to each other, a cross junction 130 can have one arm form a non-perpendicular (e.g., acute, obtuse) angle with respect to an adjacent arm. More details of the corner junction 110, the T junction 140, the cross junction 130, and the linear section 120 are provided below with respect to FIGS. 2-5, respectively below.

The light fixture 100 can also include one or more example light modules 170, which can be part of a light module assembly 190. The light module can include one or more of a number of components. Such components can include, but are not limited to, a light source, a light engine, a circuit board, a discrete component (e.g., a resistor, a capacitor, a diode, a transistor), an energy transfer device (e.g., a transformer, an inverter, a converter), an inductor, a sensor, a controller, a transceiver, an integrated circuit, and a fuse. More details regarding the light modules 170 and the light module assembly 190 are provided below with respect to FIGS. 6A-7B.

Figure 2:
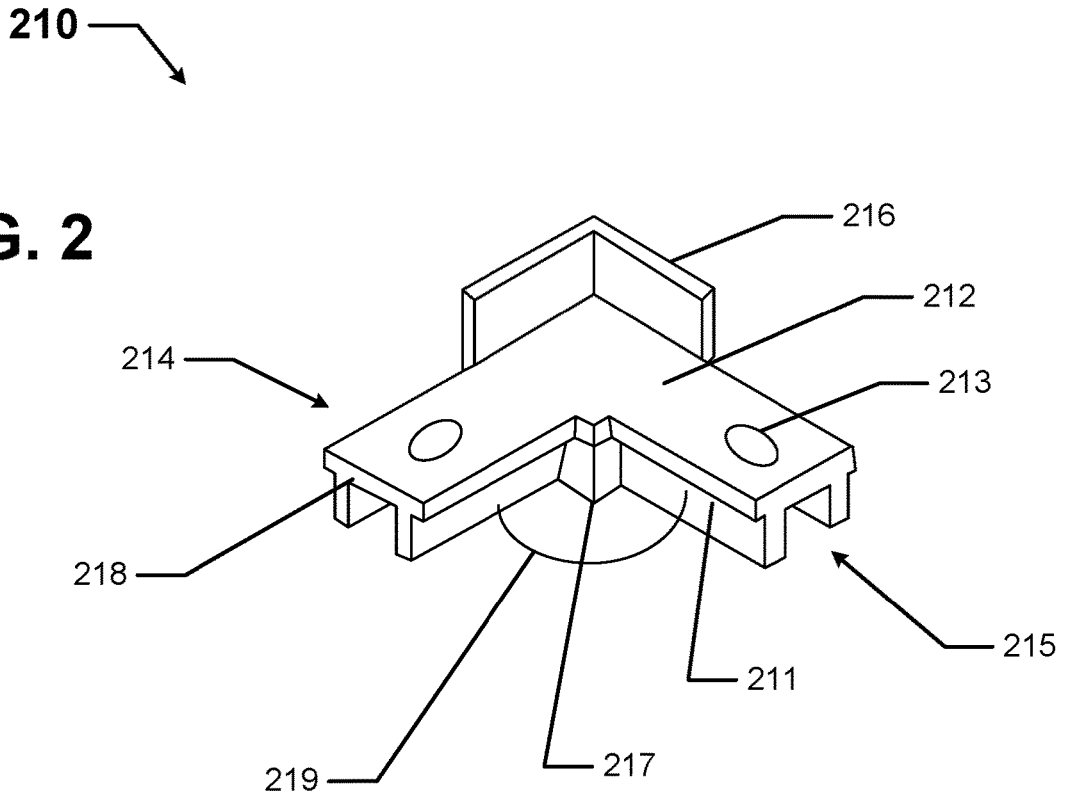
FIGS. 2-5 show various components of a modular frame in accordance with certain example embodiments.
Figure 3:
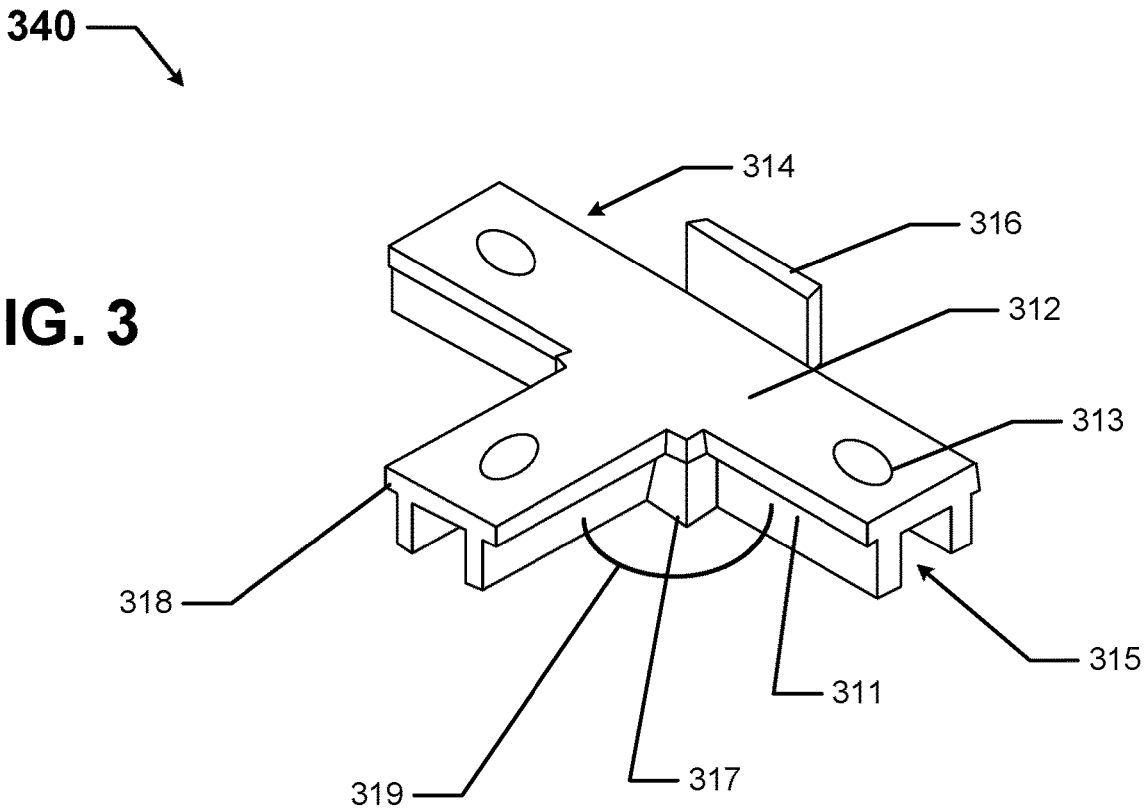
Figure 4:
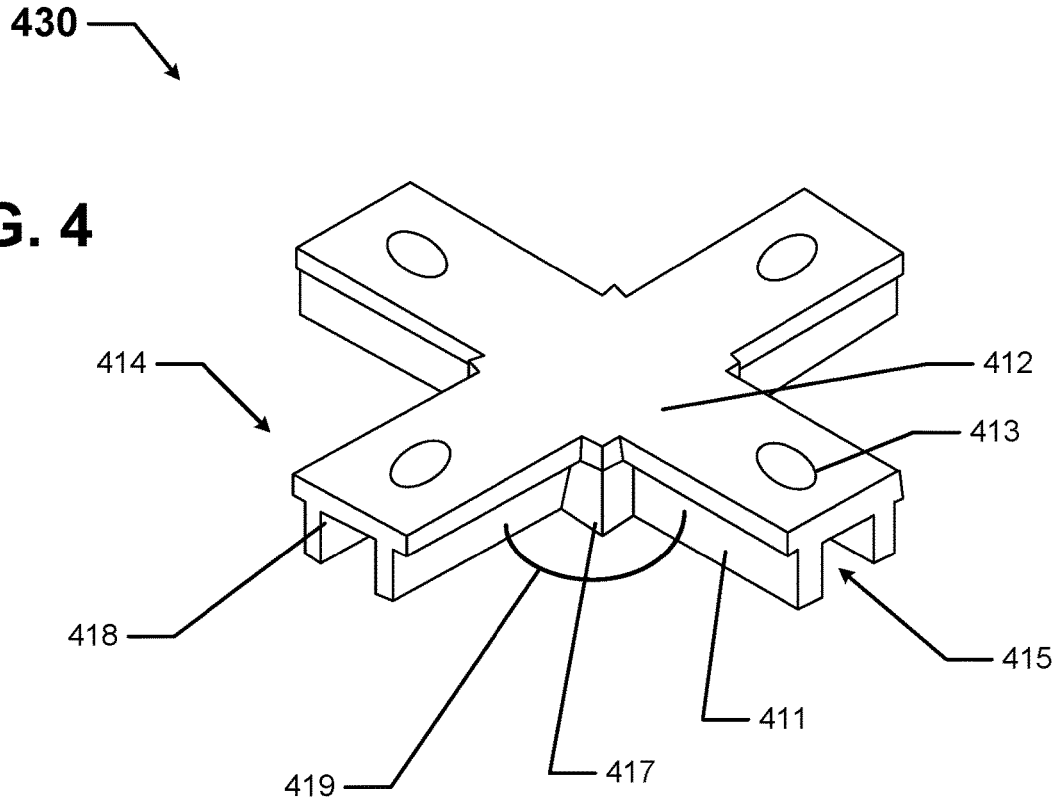
Figure 5:
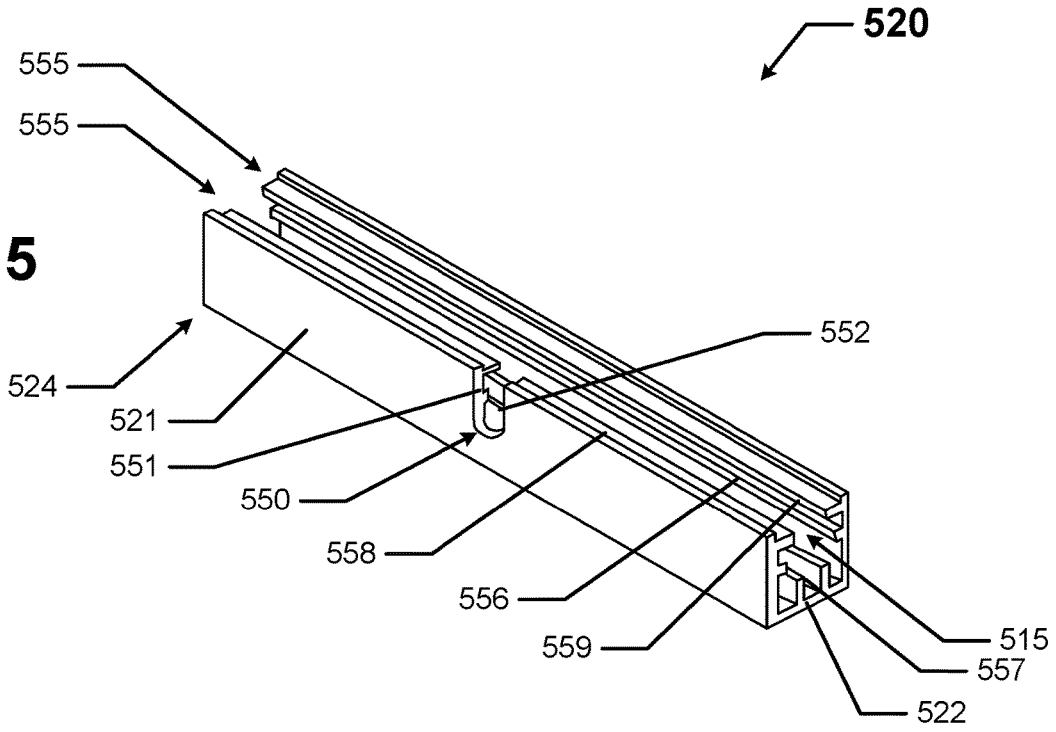

FIGS. 2-5 show various components of a modular frame in accordance with certain example embodiments. Specifically, FIG. 2 shows a top-front perspective view of a corner junction 210. FIG. 3 shows a top-side perspective view of a T junction 340. FIG. 4 shows a top-side perspective view of a cross junction 430. FIG. 5 shows a top-side perspective view of a linear section 520. The corner junction 210 of FIG. 2 can be substantially the same as the corner junction 110 of FIG. 1. The T junction 340 of FIG. 3 can be substantially the same as the T junction 140 of FIG. 1. The cross junction 430 of FIG. 4 can be substantially the same as the cross junction 130 of FIG. 1. The linear section 520 of FIG. 5 can be substantially the same as the linear section 120 of FIG. 1.

Referring to FIGS. 1-5, the corner junction 210 of FIG. 2 includes two arms 214 that form an angle 219 (e.g., 90° (as in this case), 75°) therebetween. Each arm 214 has a top surface 212 and two side surfaces 211. The side surfaces 211 can be substantially parallel with each other and substantially perpendicular with the top surface 212, as shown in FIG. 2. As a result, a channel 215 is formed between the side surfaces 211 and the top surface 212. Each of the top surface 212 and the side surfaces 211 in this example are planar. Alternatively, the top surface 212 and/or the side surfaces 211 can have any of a number of other configurations, either individually or with respect to each other.

Each of the side surfaces 211 do not meet the top surface 212 at the outer edge of the top surface 212. As a result, the top surface 212 has an overhang 218 adjacent to each of the side surfaces 211. As explained below, these overhangs 218 can be coupling features used to couple the corner junction 210 to a linear section 520. Those of ordinary skill in the art will appreciate that the top surface 212, one or both of the side surfaces 211, and/or additional features can be reconfigured and/or added to form one or more coupling features that allow the corner junction 210 to couple to another component (e.g., a linear section 520) of a light fixture (e.g., light fixture 100).

For example, as shown in FIG. 2, a protrusion 217 can be disposed on the side surfaces 211 where the two arms 214 meet. This protrusion 217 can serve as a stop against which another component (e.g., a linear section 520) of a light fixture (e.g., light fixture 100) can abut. As another example, as shown in FIG. 2, the corner junction 210 can include an extension 216 that extends upward from part of the outer edge of the top surface 212. This extension 216 can be configured (e.g., height, width) to provide a substantially seamless transition between the corner junction 210 and any adjoining components (e.g., linear section 520). In this case, the height of the extension 216 is designed to become planar with the top edge of the linear section 520 when the corner junction 210 is coupled to the linear section 520. Further, in this case, the width of the extension 216 is designed to act as a stop, in conjunction with the protrusion 217, against which an adjoining component (e.g., a linear section 520) can abut.

As still another example, as shown in FIG. 2, the top surface 212 of one or both arms 214 of the corner junction 210 can have a throughway 213 (a type of aperture) that traverses the thickness of the top surface 212. This throughway 213 can act as a conduit, allowing one or more electrical conductors to pass therethrough. These throughways 213 can be configured for this purpose. For example, as in this case, the throughways 213 form a non-normal angle with the top surface 212 so that an electrical conductor that is disposed therein is not bent at a harsh angle. This can be especially helpful if the height of the side surfaces 211 is small. As another example, the top surface 212 can have a rounded protrusion adjacent to each throughway 213 and the outer edge of each arm 214 to help structurally reinforce the top surface 212. Another example of a corner junction is shown below with respect to FIGS. 15A and 15B.

The T junction 340 of FIG. 3 includes three arms 314 that form one or more angles 319 (e.g., 90° (as in this case), 180°, 75°) therebetween. Each arm 314 has a top surface 312 and two side surfaces 311. The side surfaces 311 can be substantially parallel with each other and substantially perpendicular with the top surface 312, as shown in FIG. 3. As a result, a channel 315 is formed between the side surfaces 311 and the top surface 312. Each of the top surface 312 and the side surfaces 311 in this example are planar. Alternatively, the top surface 312 and/or the side surfaces 311 can have any of a number of other configurations, either individually or with respect to each other.

As was the case in FIG. 2, each of the side surfaces 311 do not meet the top surface 312 at the outer edge of the top surface 312. As a result, the top surface 312 has an overhang 318 adjacent to each of the side surfaces 311. As explained below, these overhangs 318 can be coupling features used to couple the corner junction 310 to a linear section 520. Those of ordinary skill in the art will appreciate that the top surface 312, one or both of the side surfaces 311, and/or additional features can be reconfigured and/or added to form one or more coupling features that allow the corner junction 310 to couple to another component (e.g., a linear section 520) of a light fixture (e.g., light fixture 100).

For example, as shown in FIG. 3, a protrusion 317 can be disposed on the side surfaces 311 where the two arms 314 meet. Each protrusion 317 can serve as a stop against which another component (e.g., a linear section 520) of a light fixture (e.g., light fixture 100) can abut. As another example, as shown in FIG. 3, the corner junction 310 can include an extension 316 that extends upward from part of the outer edge of the top surface 312. This extension 316 can be configured (e.g., height, width) to provide a substantially seamless transition between the T junction 340 and any adjoining components (e.g., linear section 520). In this case, the height of the extension 316 is designed to become planar with the top edge of the linear section 520 when the T junction 340 is coupled to the linear section 520. Further, in this case, the width of the extension 316 is designed to act as a stop, in conjunction with the protrusions 317, against which an adjoining component (e.g., a linear section 520) can abut.

As still another example, as shown in FIG. 3, the top surface 312 of one or more arms 314 of the T junction 340 can have a throughway 313 (a type of aperture) that traverses the thickness of the top surface 312. As was the case in FIG. 2, this throughway 313 can act as a conduit, allowing one or more electrical conductors to pass therethrough. These throughways 313 can be configured for this purpose. For example, as in this case, the throughways 313 form a non-normal angle with the top surface 312 so that an electrical conductor that is disposed therein is not bent at a harsh angle. This can be especially helpful if the height of the side surfaces 311 is small. As another example, the top surface 312 can have a rounded protrusion adjacent to each throughway 313 and the outer edge of each arm 314 to help structurally reinforce the top surface 312. Another example of a T junction is shown below with respect to FIGS. 16A and 16B.

The cross junction 430 of FIG. 4 includes four arms 414 that form one or more angles 419 (e.g., 90° (as in this case), 180°, 75°) therebetween. Each arm 414 has a top surface 412 and two side surfaces 411. The side surfaces 411 can be substantially parallel with each other and substantially perpendicular with the top surface 412, as shown in FIG. 4. As a result, a channel 415 is formed between the side surfaces 411 and the top surface 412. Each of the top surface 412 and the side surfaces 411 in this example are planar. Alternatively, the top surface 412 and/or the side surfaces 411 can have any of a number of other configurations, either individually or with respect to each other.

As was the case in FIGS. 2 and 3, each of the side surfaces 411 do not meet the top surface 412 at the outer edge of the top surface 412. As a result, the top surface 412 has an overhang 418 adjacent to each of the side surfaces 411. As explained below, these overhangs 418 can be coupling features used to couple the corner junction 410 to a linear section 520. Those of ordinary skill in the art will appreciate that the top surface 412, one or both of the side surfaces 411, and/or additional features can be reconfigured and/or added to form one or more coupling features that allow the corner junction 410 to couple to another component (e.g., a linear section 520) of a light fixture (e.g., light fixture 100).

For example, as shown in FIG. 4, a protrusion 417 can be disposed on the side surfaces 411 where the two arms 414 meet. Each protrusion 417 can serve as a stop against which another component (e.g., a linear section 520) of a light fixture (e.g., light fixture 100) can abut. As another example, as shown in FIG. 4, the corner junction 410 can include an extension 416 that extends upward from part of the outer edge of the top surface 412. This extension 416 can be configured (e.g., height, width) to provide a substantially seamless transition between the cross junction 430 and any adjoining components (e.g., linear section 520). In this case, the height of the extension 416 is designed to become planar with the top edge of the linear section 520 when the cross junction 430 is coupled to the linear section 520. Further, in this case, the width of the extension 416 is designed to act as a stop, in conjunction with the protrusions 417, against which an adjoining component (e.g., a linear section 520) can abut.

As still another example, as shown in FIG. 4, the top surface 412 of one or more arms 414 of the cross junction 430 can have a throughway 413 (a type of aperture) that traverses the thickness of the top surface 412. As was the case in FIGS. 2 and 3, this throughway 413 can act as a conduit, allowing one or more electrical conductors to pass therethrough. These throughways 413 can be configured for this purpose. For example, as in this case, the throughways 413 form a non-normal angle with the top surface 412 so that an electrical conductor that is disposed therein is not bent at a harsh angle. This can be especially helpful if the height of the side surfaces 411 is small. As another example, the top surface 412 can have a rounded protrusion adjacent to each throughway 413 and the outer edge of each arm 414 to help structurally reinforce the top surface 412. Another example of a cross junction is shown below with respect to FIGS. 17A and 17B.

The linear section 520 of FIG. 5 has a bottom surface 522 and two side surfaces 521 that form a U-shaped channel 515 that traverses the length of the linear section 520. Each end 524 of the linear section 520 can be equivalent to an arm (e.g., arm 214) of an adjoining component (e.g., corner junction 210). The linear section 520 can include one or more of a number of coupling features that allow the linear section 520 to couple with another component (e.g., corner junction 210, T junction 340, cross junction 430) of the frame.

For example, as shown in FIG. 5, the channel 515 can have disposed therein one or more (in this case, two) coupling features 557. These coupling features 557 are planar segments that have one end located at an end (e.g., distal end, proximal end) of the linear section 520 and extend some distance (e.g., the length of an arm (e.g., arm 414), the entire length of the linear section 520) away from such end. The coupling features 557 in this example are substantially parallel with each other and with the side surfaces 521, and are substantially perpendicular with the bottom surface 522. The coupling features 557 can also have a height that is no greater than the height of the side surfaces (e.g., side surfaces 211) of the adjoining component (e.g., corner junction 210). Further, the location of the coupling features 557 relative to the side surfaces 521 can be such that the side surfaces (e.g., side surfaces 311) of the adjoining component (e.g., T junction 340) can be disposed therebetween.

As another example, as shown in FIG. 5, one or both of the side surfaces 521 can have one or more (in this case, two) coupling features 555 disposed thereon. Each coupling feature 555 can protrude inward, toward the channel 515, from the top inner side of a side surface 521. Such a coupling feature 555 can be configured to couple to (e.g., slidably receive) a coupling feature (e.g., overhang 418) of an adjoining component (e.g., cross junction 430). In this case, each coupling feature 555 includes an upper protrusion 558 and a lower protrusion 556, forming a channel 559 therebetween. Protrusion 556 and protrusion 558 in this example are substantially parallel to each other and the bottom surface 522, and are substantially perpendicular to the side surface 521 from which they extend.

The upper protrusion 558 is located at the top outer edge of the side surface 521. Protrusion 558 and protrusion 556 can have the same width and length. In this case, the length of protrusion 558 and protrusion 556 is substantially the same as the length of the linear section 520. Also, in this example, the width of protrusion 556 is no greater than the length of the overhang (e.g., overhang 318) of the adjoining component (e.g., T junction 340). Further, the height of the channel 559 (also the distance between protrusion 558 and protrusion 556) is no less than the thickness of the overhang (e.g., overhang 418) of the adjoining component (e.g., cross junction 430).

The linear section 520 can also include one or more coupling features for allowing the linear section 520 to couple to a light module (e.g., light module 170) or a light module assembly (e.g., light module assembly 190). For example, as shown in FIG. 5, the linear section 520 can include a coupling feature 550 disposed in a side surface 521. In this case, the coupling feature 550 is a slot 552, defined by a slot surface 551, that traverses the thickness of the side surface 521 and extends from the top outer edge of the side surface 521 (or the upper protrusion 558, if applicable) to some point toward, but not reaching, the bottom outer edge of the side surface 521. The width of the coupling feature 550 can be wide enough to couple to (e.g., receive) a complementary coupling feature of a light module or light module assembly. An example of such a complementary coupling feature of a light module or light module assembly is discussed below with respect to FIGS. 6A-7B.

In certain example embodiments, the coupling feature 550 of the linear section 520 can be configured to transfer electrical signals (e.g., power signals, control signals, communication signals, data signals) directly to the component of the light fixture that couples thereto, without the use of electrical conductors (e.g., wires, cables). In such a case, the linear section 520 and one or more of the other components (e.g., corner junction 210, a T junction 340, a cross junction 430) of a frame (e.g., frame 105) can be configured to have a busbar-type of system disposed within their respective channels (e.g., channel 515, channel 215).

In this way, when adjoining components of the frame are properly coupled to each other, those components are both mechanically and electrically coupled to each other. Under this configuration, some features (e.g., throughway 213) of certain components of the frame can be eliminated, while other features (e.g., top surface 412 and side surfaces 411 made of electrically non-conductive material, electrical connector ends disposed within the arms (e.g., arm 314) can be added to such components. Another example of a linear section is shown below with respect to FIG. 18.

While the various components (e.g., corner junction 210, a T junction 340, a cross junction 430, linear section 520) of the frame described herein are configured to form one or more squares into which a light module assembly or light module subassembly can be disposed, those of ordinary skill in the art will appreciate that, by modifying one or more of these components and/or using other components not described herein, an example frame can be configured to form any of a number of other shapes (e.g., rectangles, triangles, hexagons, ovals, circles, random) into which light module assembly or light module subassembly can be disposed.

Figure 6A:
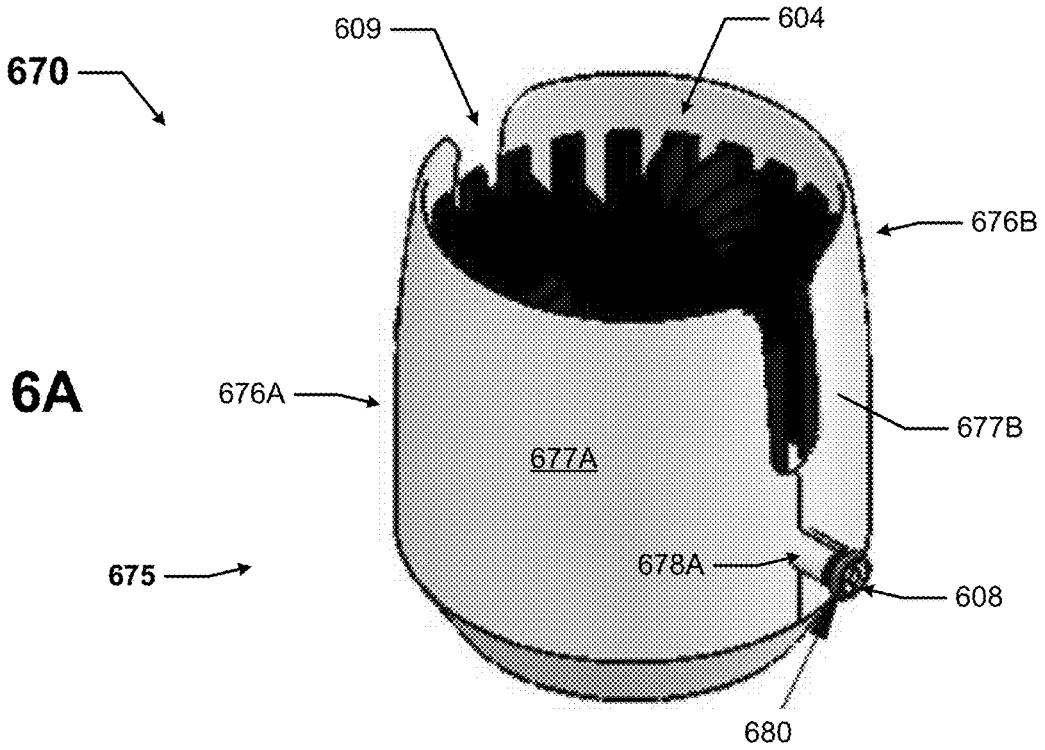
FIGS. 6A and 6B show a top-side perspective view and an exploded top-side perspective view, respectively, of a light module subassembly in accordance with certain example embodiments.
Figure 6B:
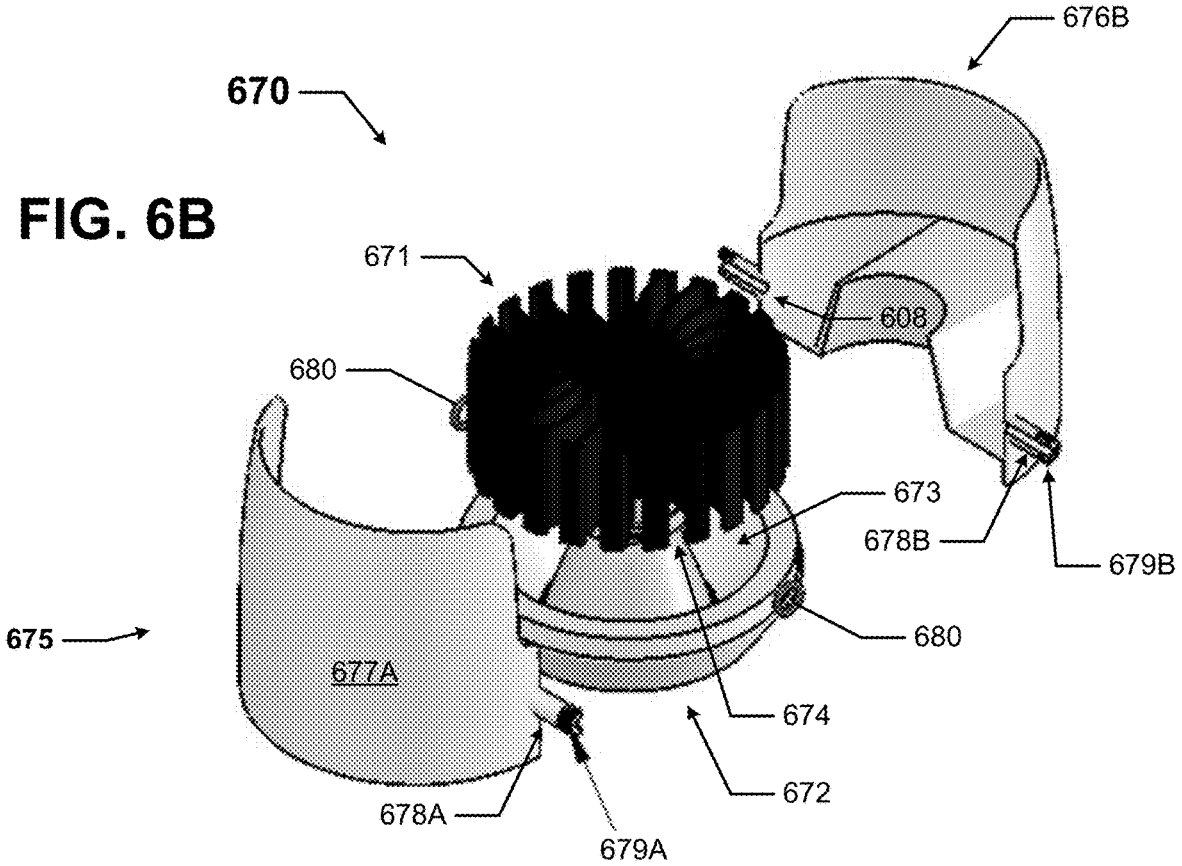
Figure 7A:
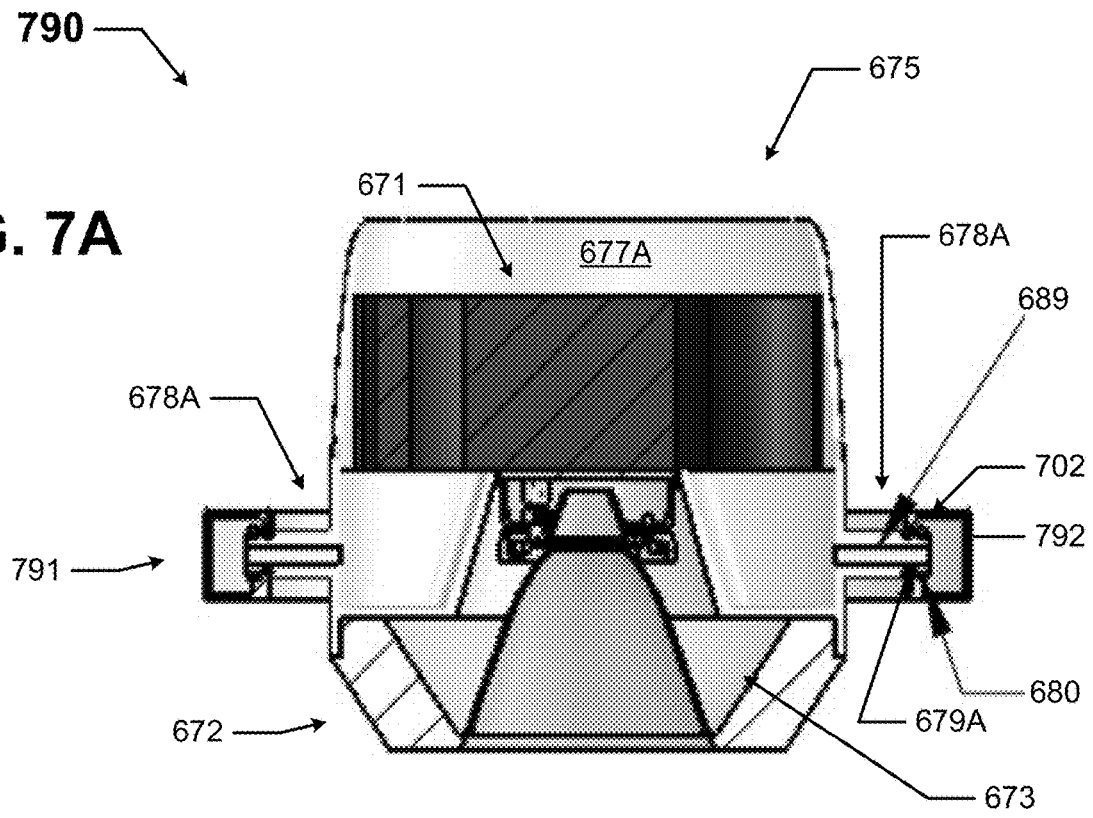
FIGS. 7A and 7B show a cross-sectional side view and a front view, respectively, of a light module assembly, which includes the light module subassembly of FIGS. 6A and 6B, in accordance with certain example embodiments.
Figure 7B:
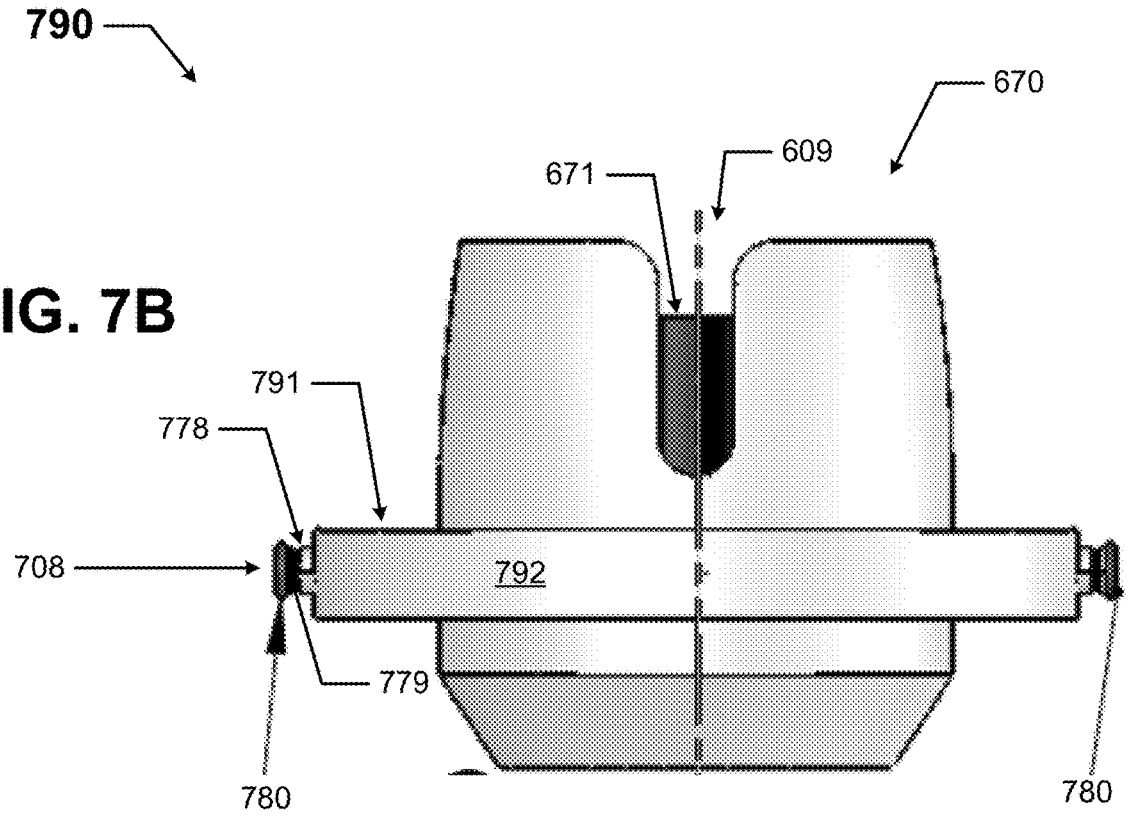

FIGS. 6A and 6B show a top-side perspective view and an exploded top-side perspective view, respectively, of a light module subassembly 670 in accordance with certain example embodiments. FIGS. 7A and 7B show a cross-sectional side view and a front view, respectively, of a light module assembly 790, which includes the light module subassembly 670 of FIGS. 6A and 6B, in accordance with certain example embodiments.

Referring to FIGS. 1-7B, the light module subassembly 670 of FIGS. 6A and 6B includes a heat sink 671, a light module 674, a reflector 673, a trim 672, and an example housing 675. The heat sink 671, the light module 674, the reflector 673, and the trim 672 of the light module subassembly 670 are standard components that can have any of a number of features, shapes, sizes, and/or configurations to provide the desired appearance and functionality for a light fixture using an example frame (e.g., frame 105) and/or an example housing 675. While the housing 675 in this example forms a circular shape when viewed from below, the housing 675 can form any of a number of other shapes (e.g., square, oval, hexagonal, irregular) when viewed from below. In such a case, the cross-sectional shape of the housing 675 can be determined, for example, by the configuration of the other components of the light module subassembly 670 and the shape of the section of the frame into which the light module subassembly 670 is disposed.

The housing 675 of FIGS. 6A and 6B includes a body 677 that forms a cavity 604 inside of which is disposed, at least in part, the heat sink 671, the light module 674, the reflector 673, and the trim 672. The top of the body 677 is open, allowing heat absorbed by the heat sink 671 to dissipate into the ambient environment. When the body 677 is made of thermally conductive material, then the body 677 can absorb some of the heat generated within the cavity 604 and dissipate that heat into the ambient environment. In some cases, such as in this example, the body 677 can have one or more features that help more ambient air reach the heat sink 671 to dissipate the heat absorbed by the heat sink 671. In the housing 675 of FIGS. 6A and 6B, there are two slots 609 that extend from the top of the housing 675 to approximately halfway down the height of the housing (adjacent to the coupling features 678). Examples of other such features can include, but are not limited to, perforations, apertures, and vents.

As shown in FIGS. 6A and 6B, the example housing 675 can be divided into multiple (in this case, two) pieces that couple together. In this case, the body 677 is made up of body 677A and body 677B. The different pieces of the body 677 can be coupled together directly (e.g., using one or more coupling features on one part of the body 677 (e.g., body 677A) and one or more complementary coupling features on an adjacent part of the body (e.g., body 677B)) and/or indirectly (e.g., using coupling features on the body 677 and complementary coupling features on one or more components (e.g., the trim 672) of the remainder of the light module subassembly 670).

The light module subassembly 670 can include one or more coupling features that allow the light module subassembly 670 to become moveably coupled to the frame (e.g., frame 105) or a light module assembly 790. For example, as shown in FIGS. 6A and 6B, the light module subassembly 670 can include two coupling features 678 disposed substantially opposite each other on the body 677 of the housing 675. These coupling features 678 can be substantially identical to each other. In this case, each coupling feature 678 is an extension that extends away from the body 677. The extension of the coupling feature 678 can include a channel 679 into which a sealing member 680 (e.g., an o-ring) made of an elastomeric material (rubber) is disposed.

When the light module subassembly 670 is coupled to a coupling feature 550 of a linear section 520, the sealing member 680 makes contact with the slot surface 551 of the slot 552. When this occurs, the sealing member 680, provides some amount of resistance (friction), but not enough to prevent rotational movement along the axis formed by the coupling features 678 of the housing 675, and greater than the force of gravity on the housing 675. In other words, once the light module subassembly 670 is coupled to the frame (or portion thereof), the friction applied by the sealing member 680 prevents the light module subassembly 670 from rotating relative to the frame without sufficient force applied by a user to do so.

This configuration allows for the rotation (movement) of the light module subassembly 670 relative to the frame using a simple movement without the use of tools and/or a number of mechanical components (e.g., ridged washers, nut, knob, screw). If the sealing member 680 begins to lose its effectiveness (e.g., from age, from frequent use), the sealing member 680 can easily be replaced to re-establish the integrity of the coupling between the light module subassembly 670 and the frame.

When the body 677 of the housing 675 of the light module subassembly 670 has multiple pieces, as in FIGS. 6A and 6B, one or more of the coupling features 678 can similarly be in multiple pieces. For example, in this case, each of the two coupling features 678 is divided in half, so that coupling features 678A join with (or, if coupling features are disposed on the coupling features 678, couple to) coupling features 678B to form whole coupling features 678. In alternative embodiments, when the body 677 of the housing 675 has multiple pieces, each coupling feature 678 can be whole on one of the pieces of the housing 677.

One or more of the coupling features 678 can have a cavity 608 that traverses therethrough. In such a case, one or more electrical conductors can be disposed within the cavity 608, transferring electrical signals (e.g., power signals, control signals, communication signals, data signals) between the light module 674 and another component in the lighting system. This allows all wiring for the light fixture to be hidden from view. Alternatively, instead of a channel, the interior of the coupling feature 678 can be made of an electrically conductive material, used in place of electrical conductors to transfer electrical signals between the light module 674 and another component in the lighting system. In this latter case, the coupling feature 678 can include an electrical connector or other form of energy transfer from the frame to the light module subassembly 670.

As discussed above, when the one or more coupling features 678 of the housing 675 are coupled to the frame (e.g., coupling feature 550 of linear section 520), the light module subassembly 670 can only rotate about the axis formed by the coupling features 678. In some cases, a user wants to have greater flexibility in how to rotate the light module subassembly 670, thereby having more control over how light emitted by the light module subassembly 670 is directed. To solve this problem, the light module subassembly 670 can be part of a light module assembly 790, as shown in FIGS. 7A and 7B.

With the light module assembly 790 of FIGS. 7A and 7B, the coupling features 678 of the housing 675 of the light module subassembly 670 is not coupled directly to the frame, but rather to an auxiliary section 791. Here, the auxiliary section 791 has one or more coupling features 702 that can be configured substantially the same as the coupling features 550 described above with respect to the linear section 520. Alternatively, rather than slots, the coupling features 702 can be apertures that receive the sealing member 680 wrapped around each coupling feature 678. In such a case, the light module assembly 790 can be preassembled.

The auxiliary section 791 can also include one or more coupling features 778 that are substantially the same as the coupling features 678 of the housing 675 of the light module subassembly 670. In other words, each coupling feature 778 can be an extension that extends away from the body 792 of the auxiliary section 791. The extension of the coupling feature 778 can include a channel 779 into which a sealing member 780 can be disposed. The sealing member 780 can be the substantially the same as, or different than, the sealing member 680 described above. The auxiliary section 791 so that the coupling features 778 and the coupling features 702 are substantially aligned in a plane.

By spacing the coupling features 778 about 90° apart from the coupling features 702, a much greater degree of rotational movement (subject to the height of the housing 675 relative to the frame) can be achieved, rather than a rotation along one mere axis, as in FIGS. 6A and 6B. This allows a user to have much greater control and flexibility over how light emitted by the light module assembly 790 is directed. In certain example embodiments, a light module assembly 790 can include more than one auxiliary section 791. In such a case, each auxiliary section 791 can be configured the same as, or differently than, the remainder of the auxiliary sections. When there is no auxiliary section, as in FIGS. 6A and 6B, the light module subassembly 670 can be considered a light module assembly.

One or more of the coupling features 778 can have a cavity 708 that traverses therethrough. In such a case, one or more electrical conductors can be disposed within the cavity 708, transferring electrical signals (e.g., power signals, control signals, communication signals, data signals) between the light module 774 and another component in the lighting system. Further, in such a case, the body 792 of the auxiliary section 791 can be hollow, allowing such electrical conductors to traverse therethrough to the cavity 608 of coupling feature 678. This again allows all wiring for the light fixture to be hidden from view. Alternatively, instead of a channel, the interior of the coupling feature 778 can be made of an electrically conductive material, used in place of electrical conductors to transfer electrical signals between the light module 774 and another component in the lighting system. In this latter case, the coupling feature 778 can include an electrical connector or other form of energy transfer from the frame to the light module subassembly 770. Similarly, the body 792 of the auxiliary section 791 can house an electrically conductive material and provides a point of electrical connection at the coupling feature 702 for power to continue through one or more of the coupling features 678 of the housing 675.

Figure 8:
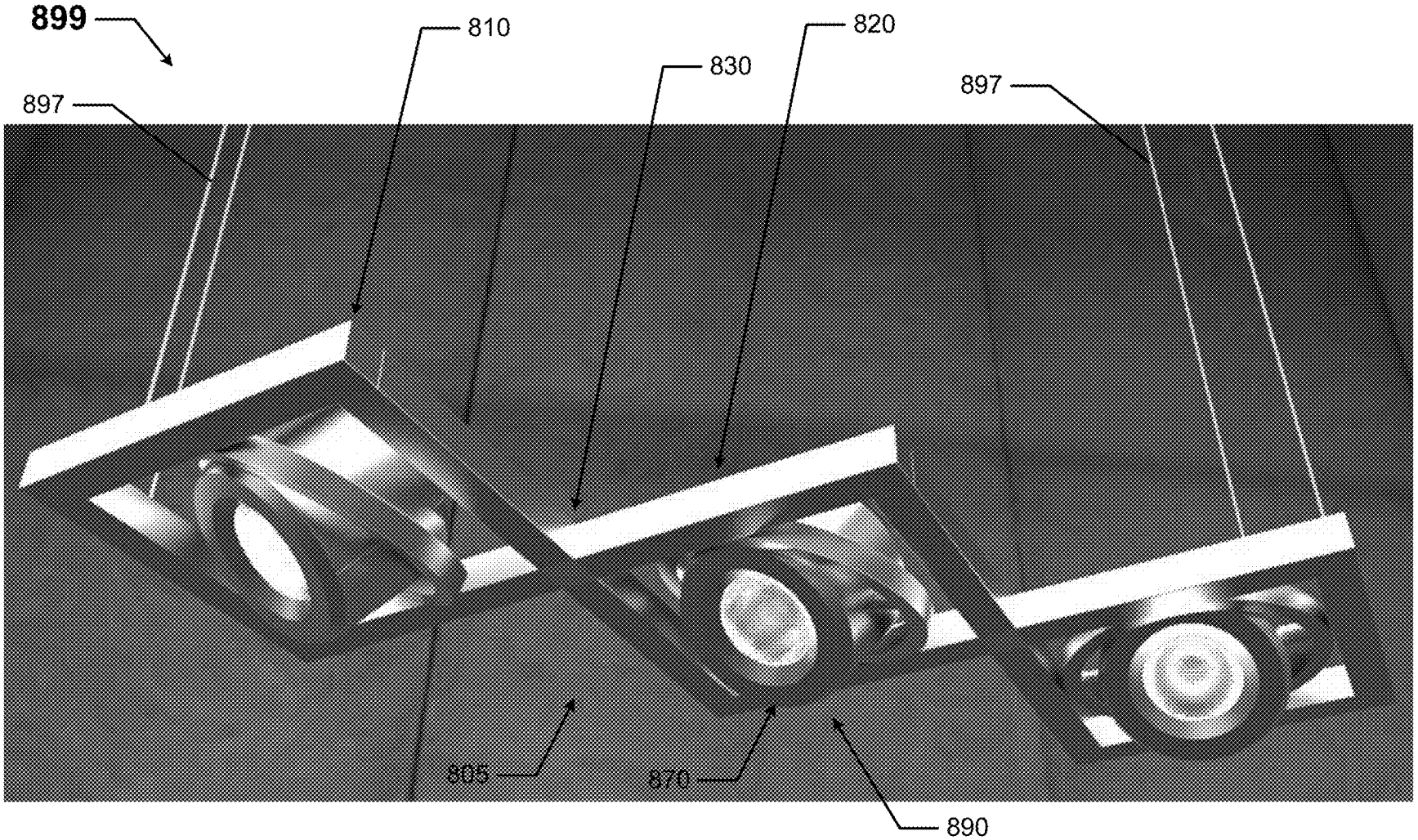
FIG. 8 shows another light fixture assembly in accordance with certain example embodiments.

FIG. 8 shows another light fixture assembly 899 in accordance with certain example embodiments. Referring to FIGS. 1-8, the light fixture assembly 899 of FIG. 8 includes three light module assemblies 890 coupled to a frame 805. In this case, the frame 805 forms three squares, each square filled by a light module assembly 890, where the squares are joined in a line at opposing points. As a result, the frame 805 of FIG. 8 only consists of corner junctions 810, cross junctions 830, and linear segments 820.

Figure 9A:
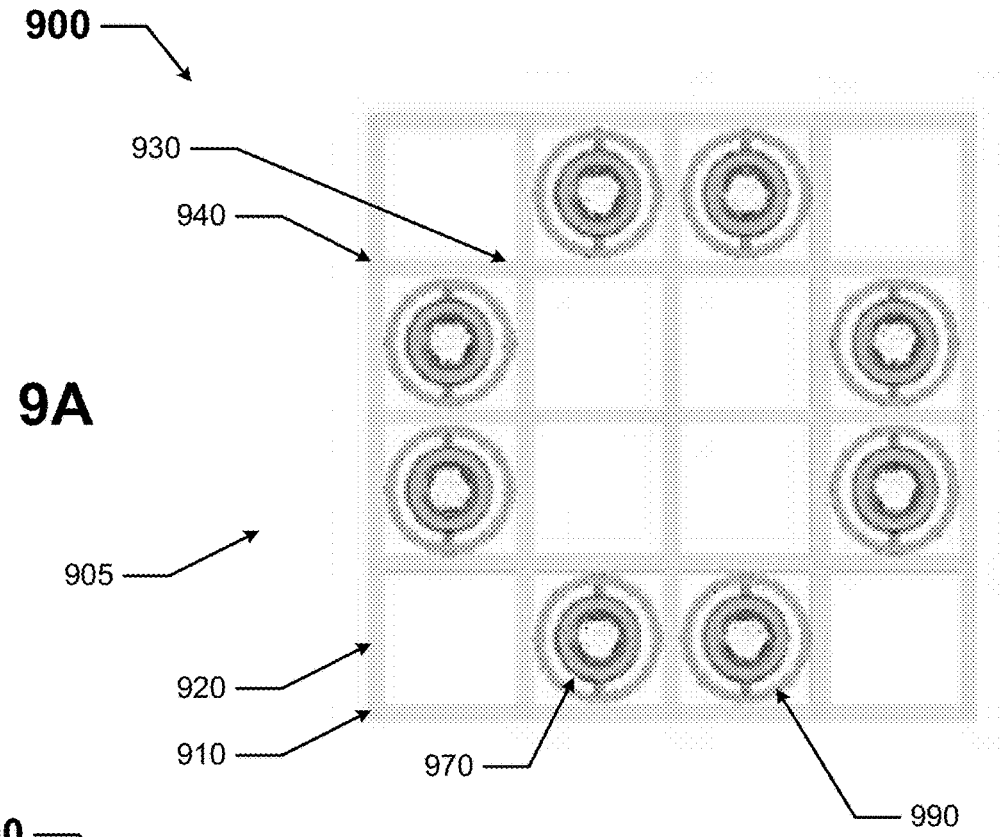
FIGS. 9A and 9B show a bottom view and a top-side perspective view, respectively, of a light fixture in accordance with certain example embodiments.
Figure 9B:
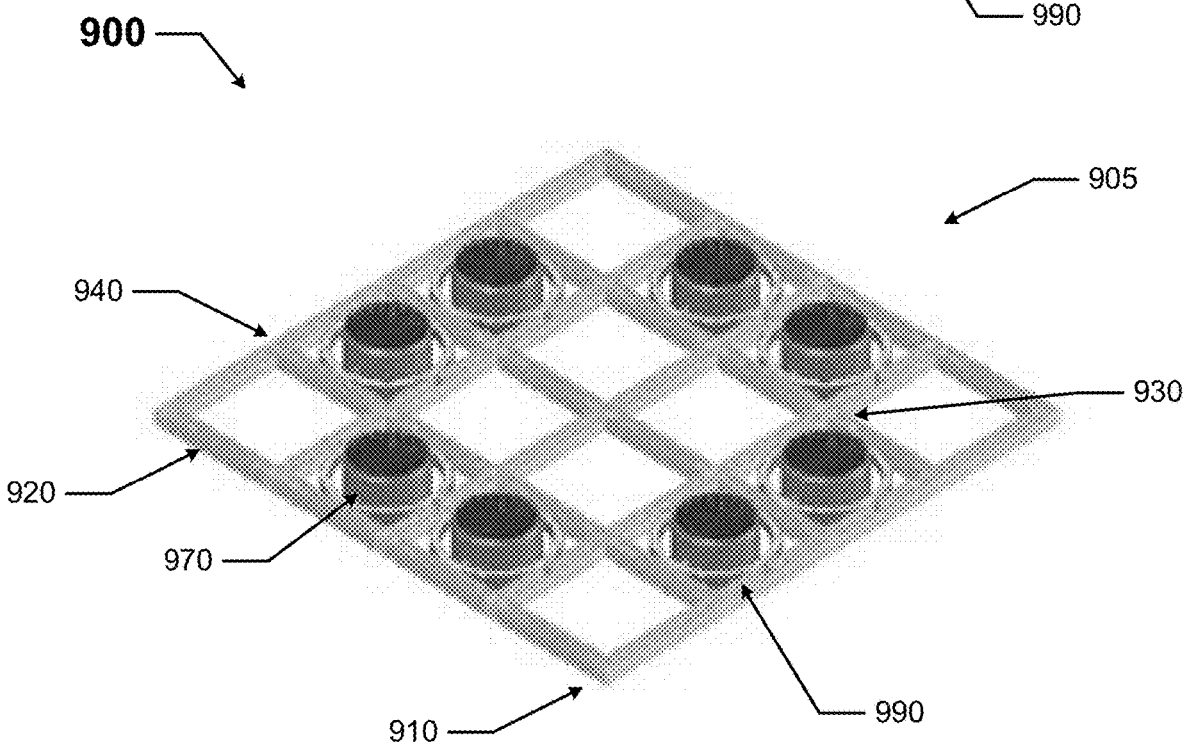

FIGS. 9A and 9B show a bottom view and a top-side perspective view, respectively, of light fixture 900 in accordance with certain example embodiments. Referring to FIGS. 1-9B, the frame 905 of the light fixture 900 of FIGS. 9A and 9B forms a 4×4 arrangement of squares, using corner junctions 910, T junctions 940, cross junctions 930, and linear segments 920. There are a total of 8 light module assemblies 990, where each light module assembly 990 occupies a square along the outer perimeter, not counting the corners.

Figure 10A:
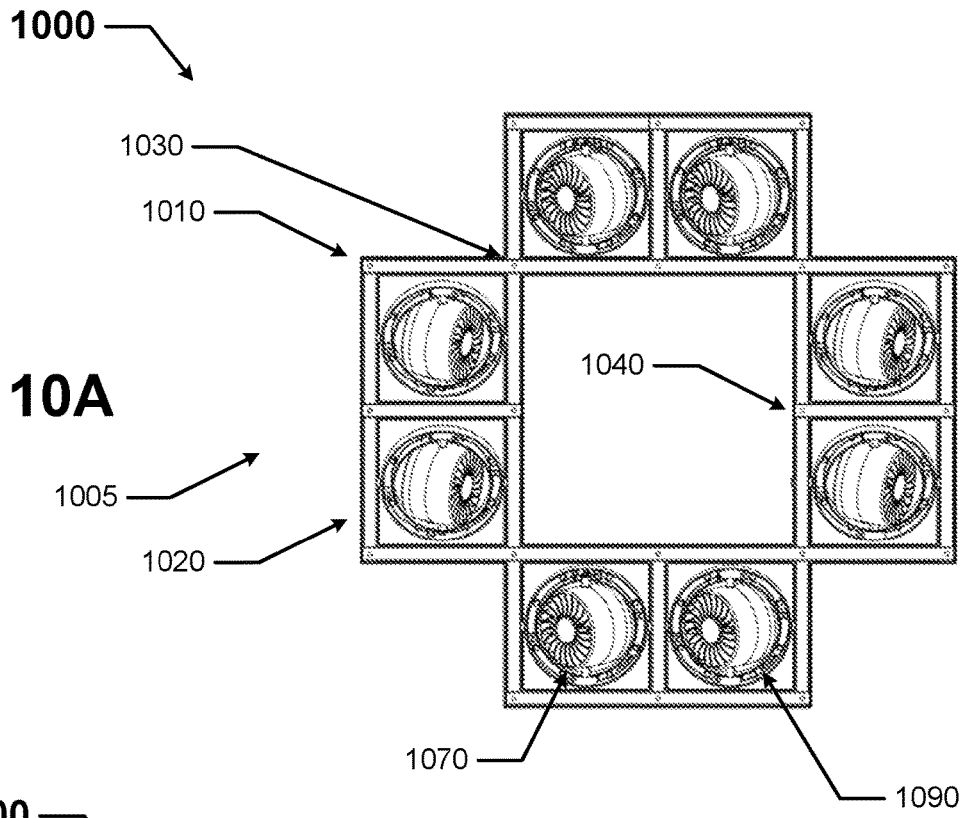
FIGS. 10A and 10B show a bottom view and a top-side perspective view, respectively, of another light fixture in accordance with certain example embodiments.
Figure 10B:
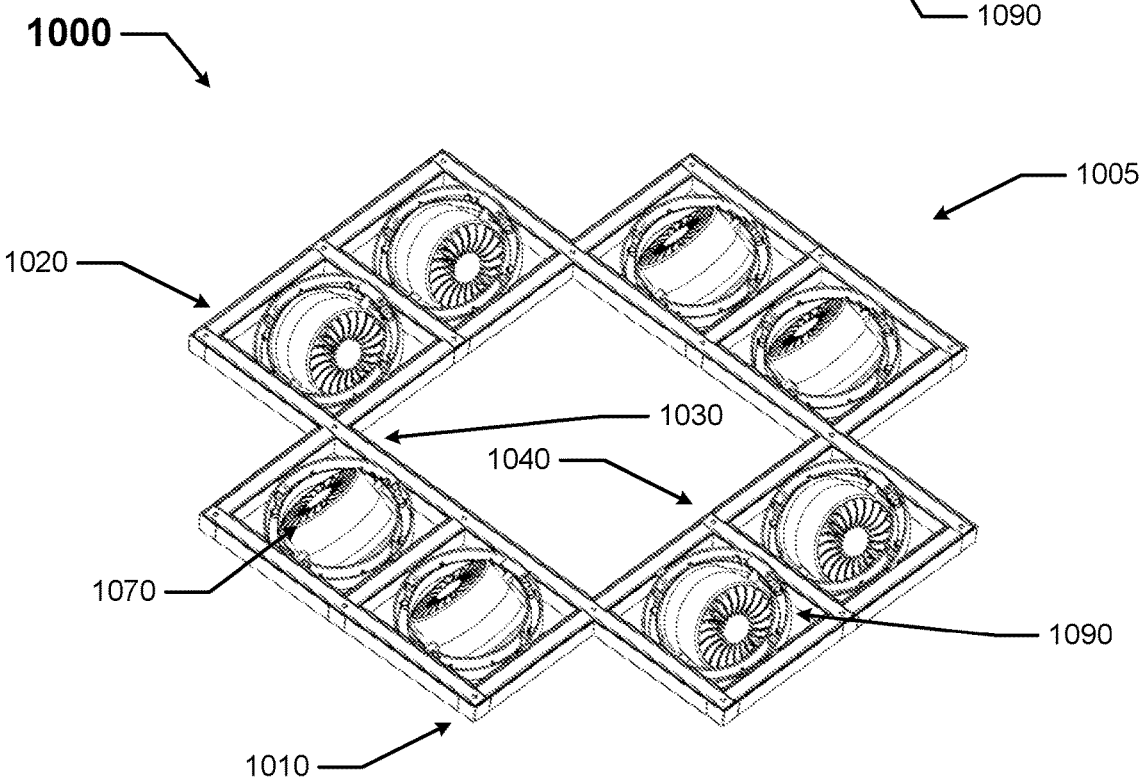

FIGS. 10A and 10B show a bottom view and a top-side perspective view, respectively, of another light fixture 10 in accordance with certain example embodiments. Referring to FIGS. 1-10B, the light fixture 1000 of FIGS. 10A and 10B looks the same as the light fixture 900 of FIGS. 9A and 9B, except that the frame 1005 of the light fixture 1000 of FIGS. 10A and 10B is reduced so that only one large square in the middle is unoccupied by a light module assembly 1090. The frame 1005 is formed using corner junctions 1010, T junctions 1040, cross junctions 1030, and linear segments 1020. There are a total of 8 light module assemblies 1090, where each light module assembly 1090 occupies the relatively small squares, all located along the outer perimeter and forming the large empty square in the middle of the frame 1005.

Figure 11B:
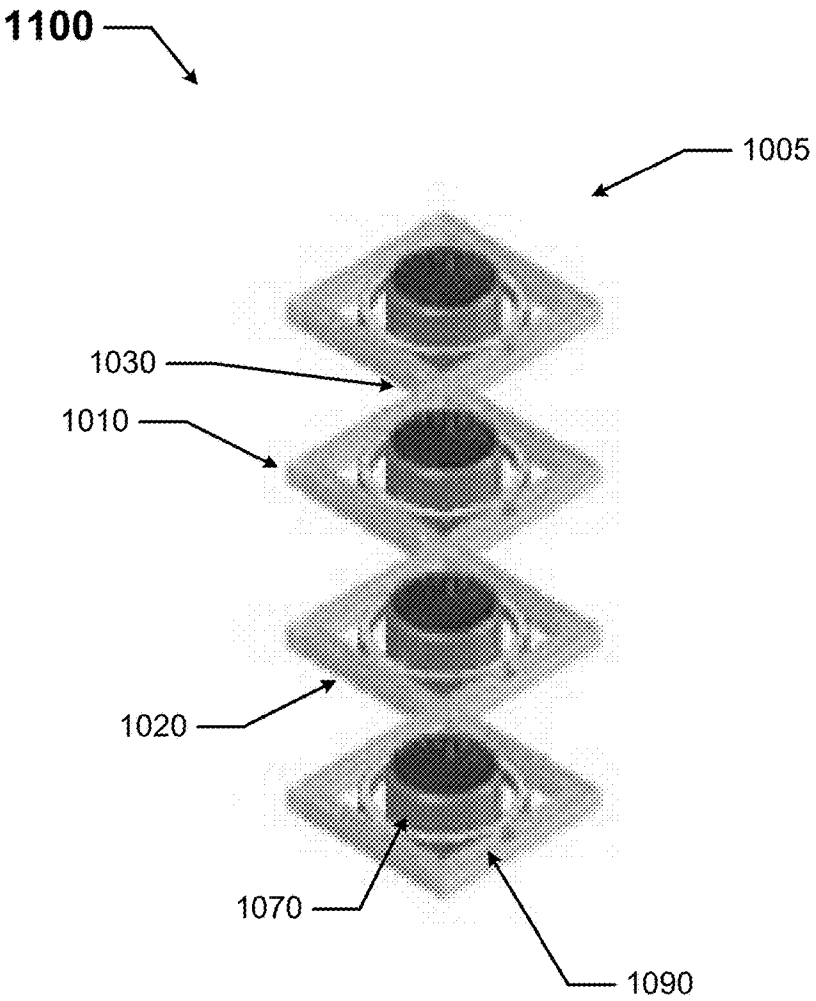
FIGS. 11A and 11B show a bottom view and a top-side perspective view, respectively, of yet another light fixture in accordance with certain example embodiments.
Figure 11A:
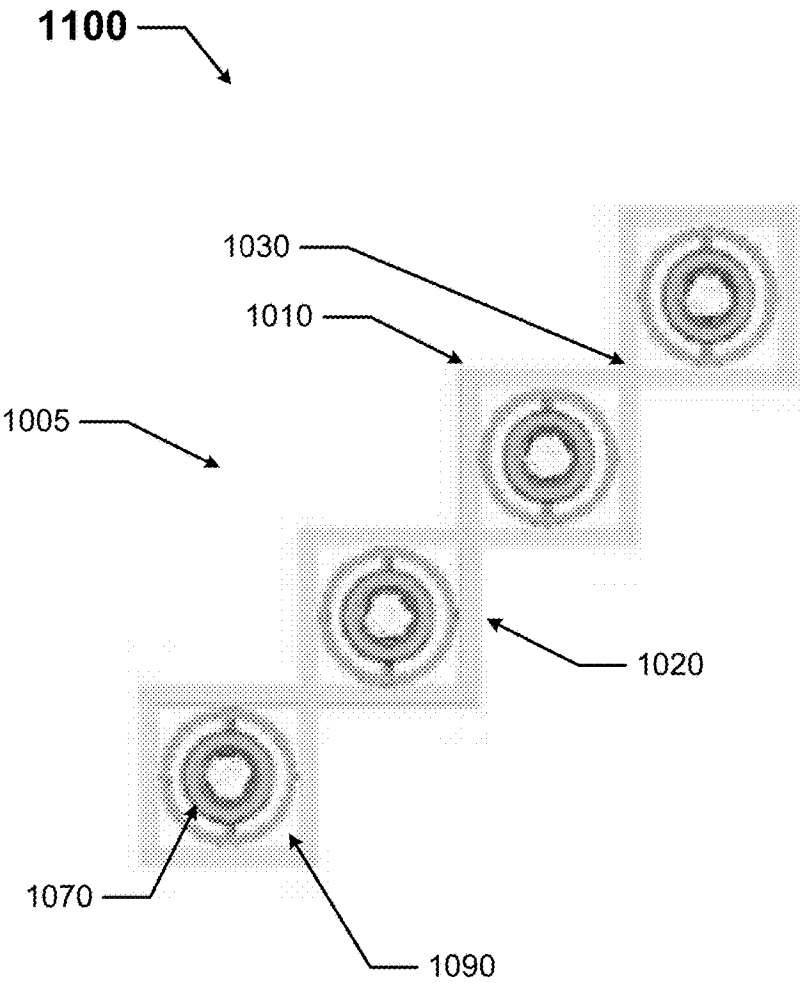

FIGS. 11A and 11B show a bottom view and a top-side perspective view, respectively, of yet another light fixture in accordance with certain example embodiments. Referring to FIGS. 1-11B, the light fixture 1100 of FIGS. 11A and 11B is substantially similar to the light fixture 800 of FIG. 8, except that the light fixture 1100 of FIGS. 11A and 11B has four light module assemblies 1190 and the frame 1105 forms four squares, each square filled by a light module assembly 1190, where the squares are joined in a line at opposing points. As a result, the frame 1105 of FIGS. 11A and 11B only consists of corner junctions 1110, cross junctions 1130, and linear segments 1120.

Figure 12A:
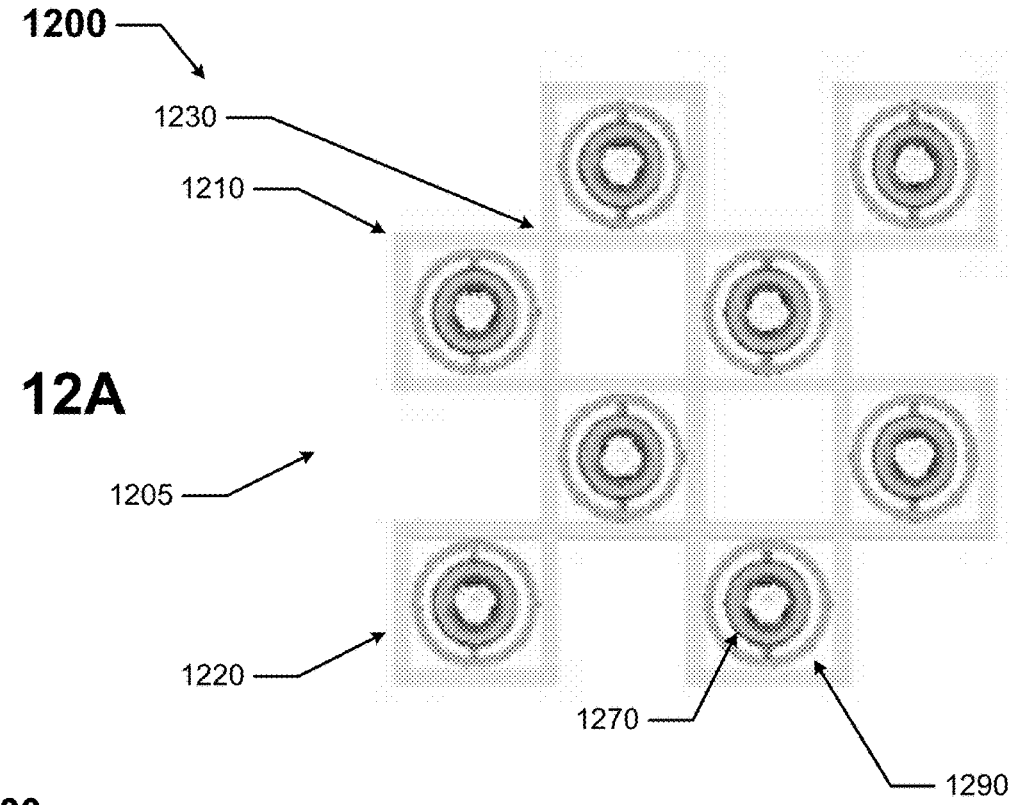
FIGS. 12A and 12B show a bottom view and a top-side perspective view, respectively, of still another light fixture in accordance with certain example embodiments.
Figure 12B:
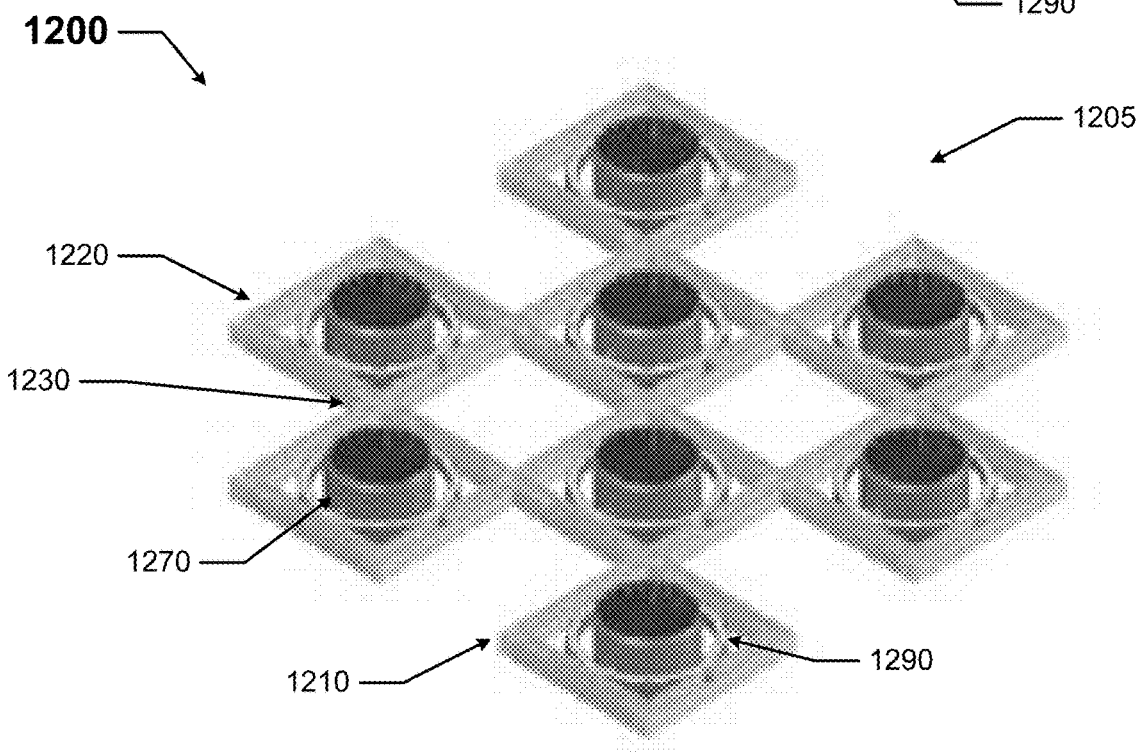

FIGS. 12A and 12B show a bottom view and a top-side perspective view, respectively, of still another light fixture in accordance with certain example embodiments. Referring to FIGS. 1-12B, the frame 1205 of the light fixture 1200 of FIGS. 12A and 12B is similar to the frame 905 of the light fixture 900 of FIGS. 9A and 9B (generally forming a 4×4 arrangement of squares), except that in this case, all squares without a light module assembly 1290 disposed therein are not framed. There are a total of 8 light module assemblies 1290, with two light module assemblies 1290 in each column, and where adjacent light module assemblies 1290 are diagonally located with respect to each other. The frame 1205 of FIGS. 12A and 12B is formed using corner junctions 1210, T junctions 1240, cross junctions 1230, and linear segments 1220.

Figure 13A:
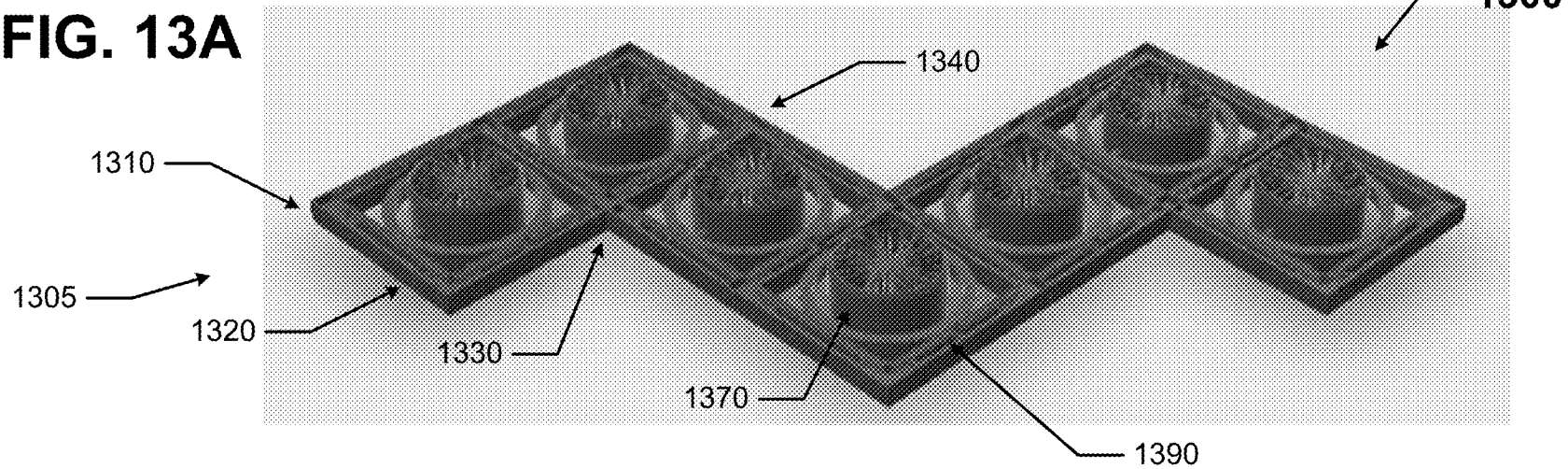
FIGS. 13A-13C show various views of yet another light fixture in accordance with certain example embodiments.
Figure 13B:
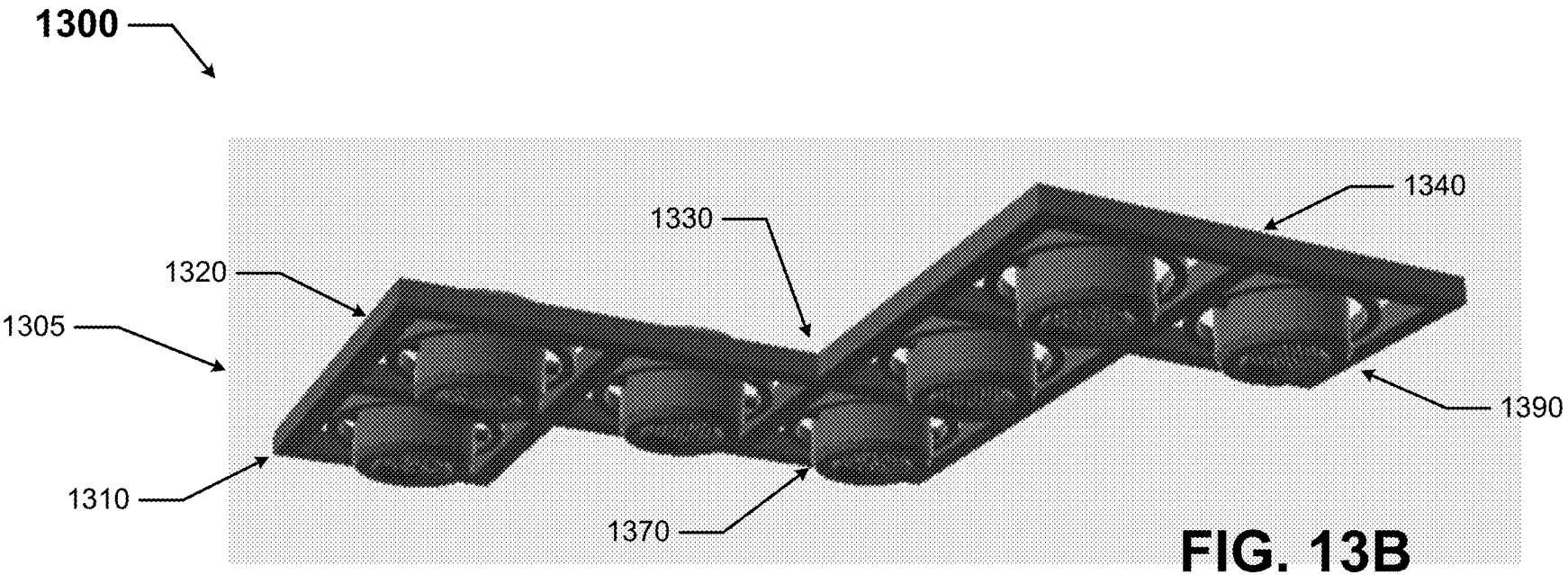
Figure 13C:
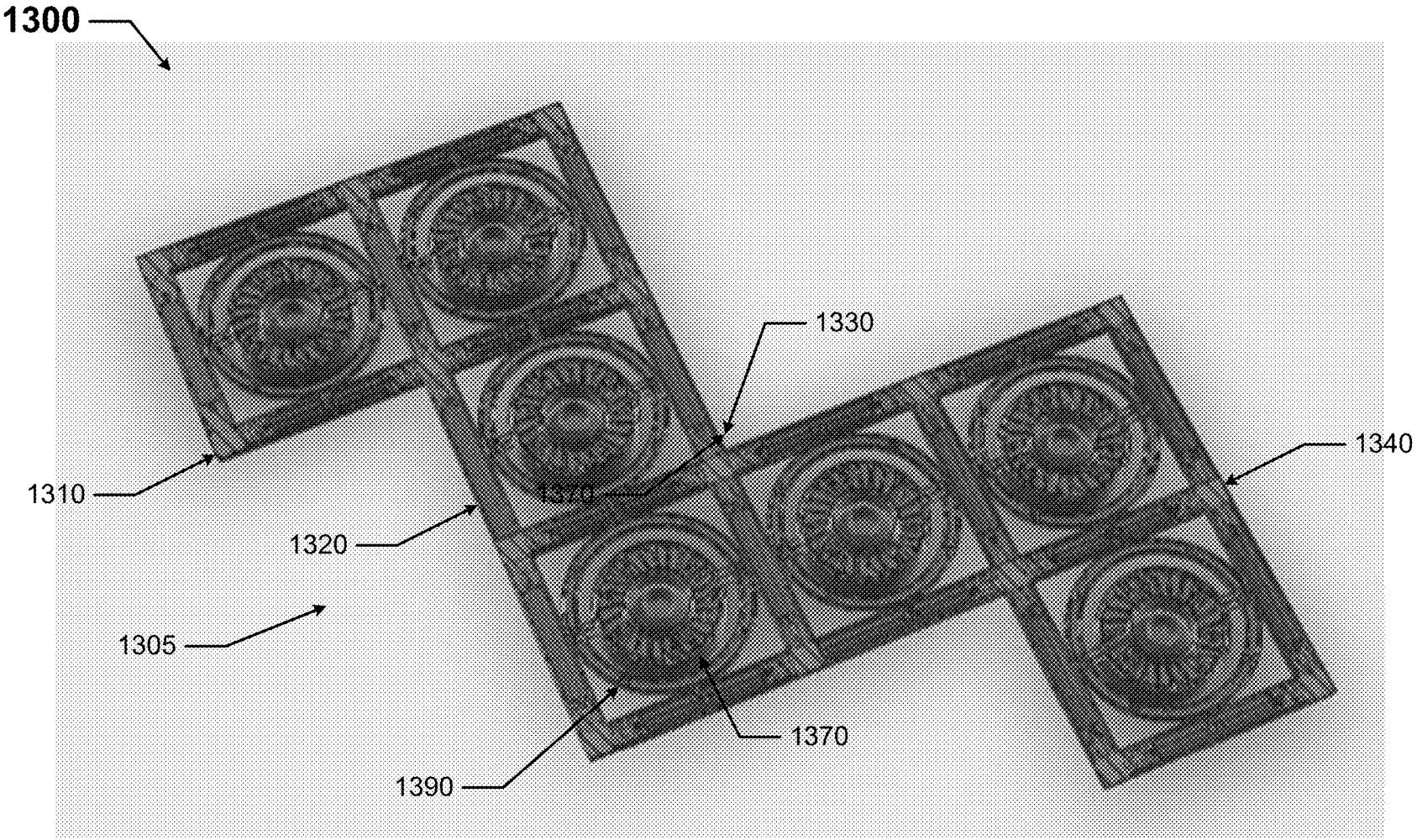

FIGS. 13A-13C show various views of yet another light fixture 1300 in accordance with certain example embodiments. Specifically, FIG. 13A shows a top-front perspective view of the light fixture 1300. FIG. 13B shows a bottom-front perspective view of the light fixture 1300. FIG. 13C shows a cross-sectional top view of the light fixture 1300. Referring to FIGS. 1-13C, the light fixture 1300 of FIGS. 13A-13C forms a zig-zag pattern with seven light module assemblies 1390 disposed within seven squares formed by the frame 1305. The frame 1305 of FIGS. 13A and 13B is formed using corner junctions 1310, T junctions 1340, cross junctions 1330, and linear segments 1320.

Figure 14A:
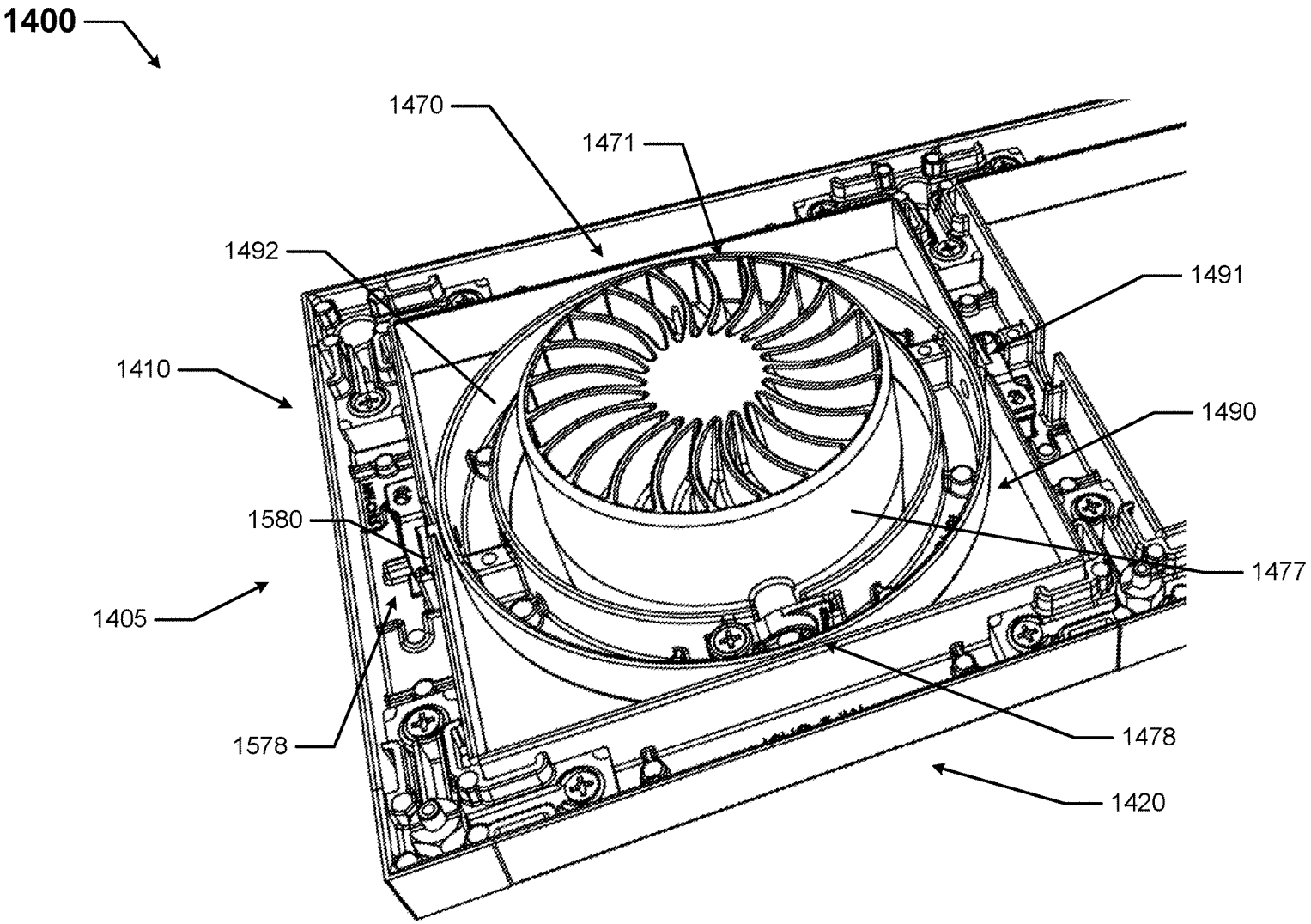
FIGS. 14A and 14B show a top-side perspective view and a top-front perspective view, respectively, of still another light fixture in accordance with certain example embodiments.
Figure 14B:
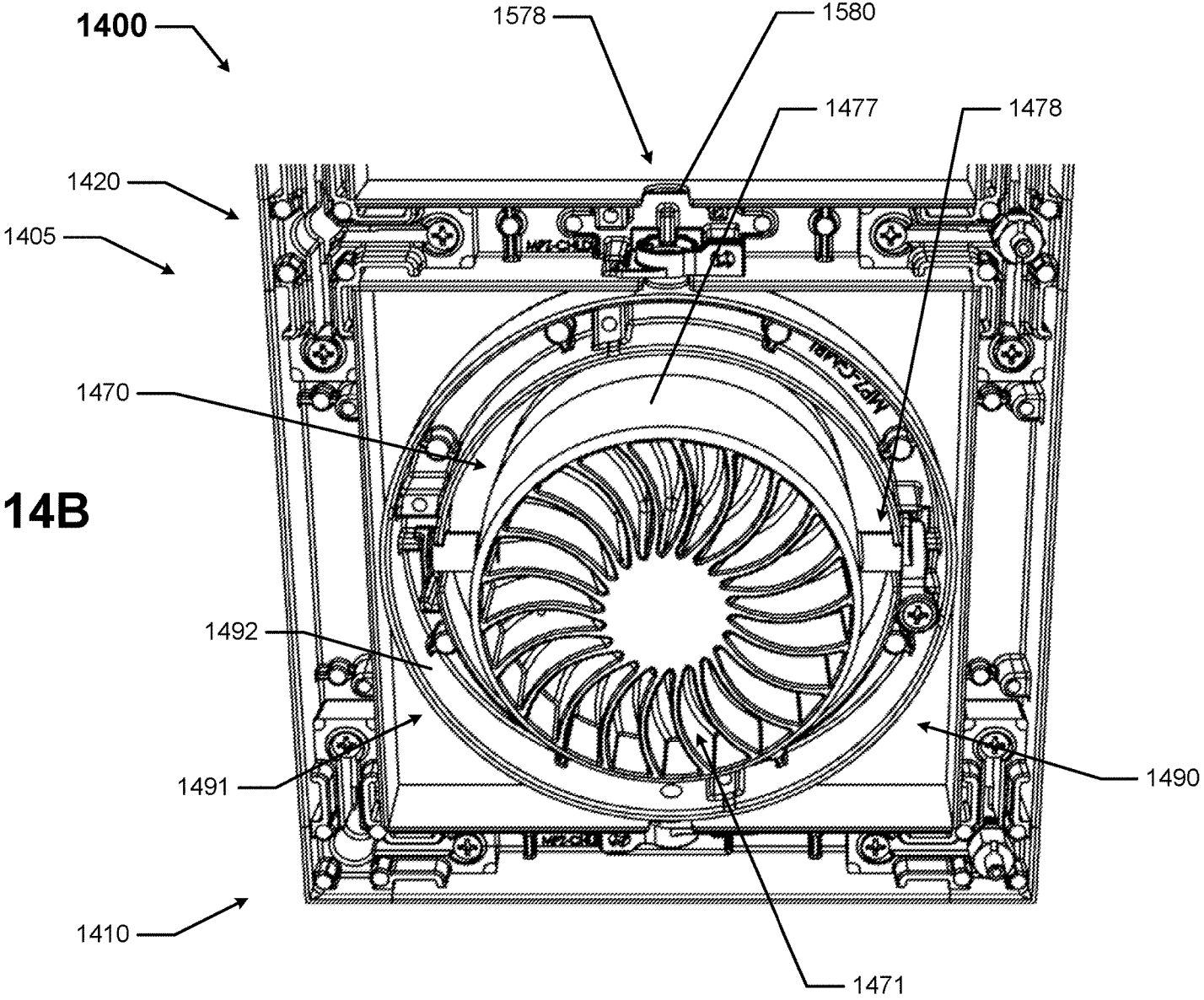

FIGS. 14A and 14B show a top-side perspective view and a top-front perspective view, respectively, of still another light fixture 1400 in accordance with certain example embodiments. Referring to FIGS. 1-14B, the light fixture 1400 of FIGS. 14A and 14B includes a single light module assembly 1490 disposed within a frame 1405 that forms a single square. The views of the light fixture 1400 provided by FIGS. 14A and 14B show in more detail how the light module subassembly 1470 moveably couples to the auxiliary section 1491, as well as how the auxiliary section 1491 of the light module assembly 1490 couples to the frame 1405. The frame 1405 in this example only uses corner junctions 1410 and linear sections 1420.

Figure 15A:
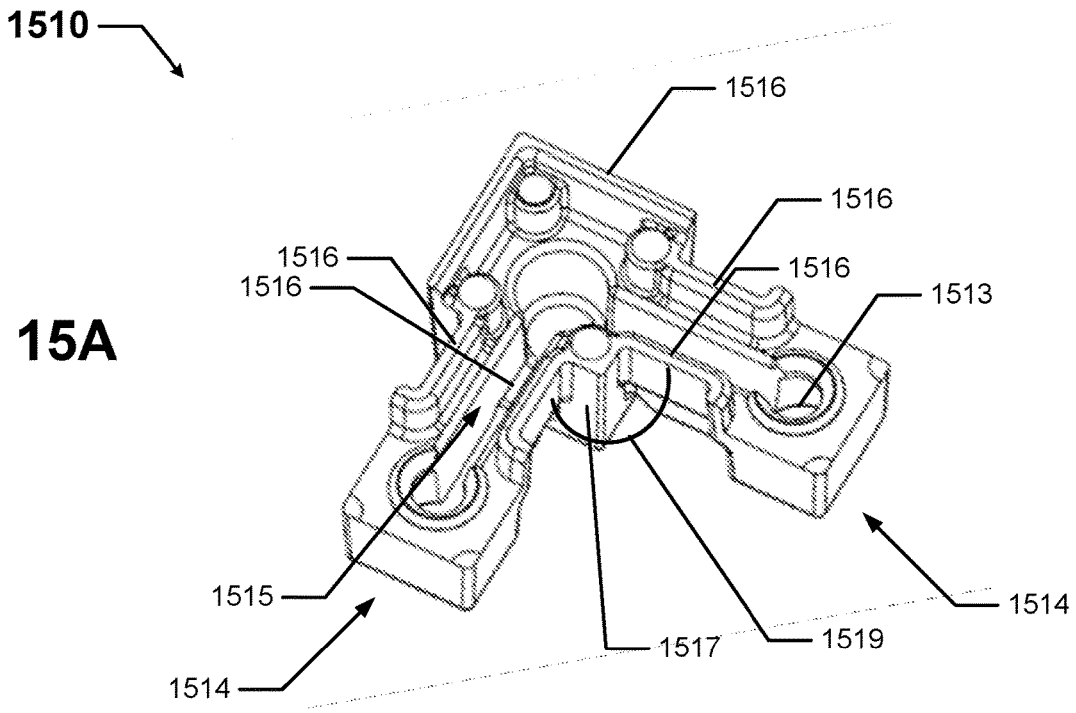
FIGS. 15A-18 show alternative components of a modular frame in accordance with certain example embodiments.
Figure 16A:
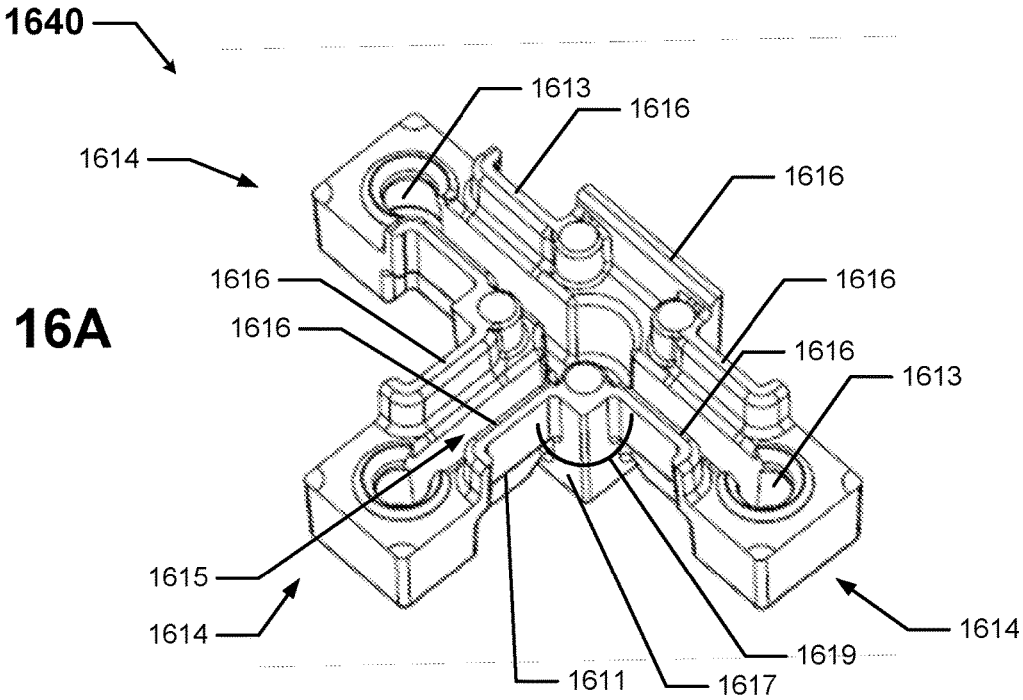
Figure 16B:
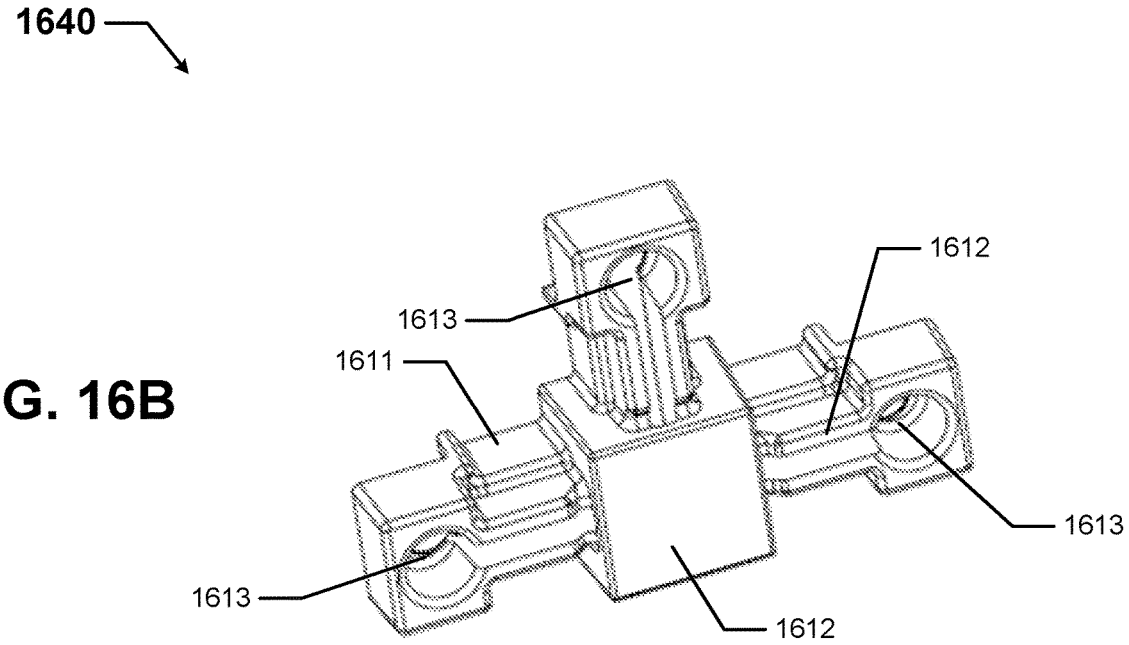
Figure 17A:
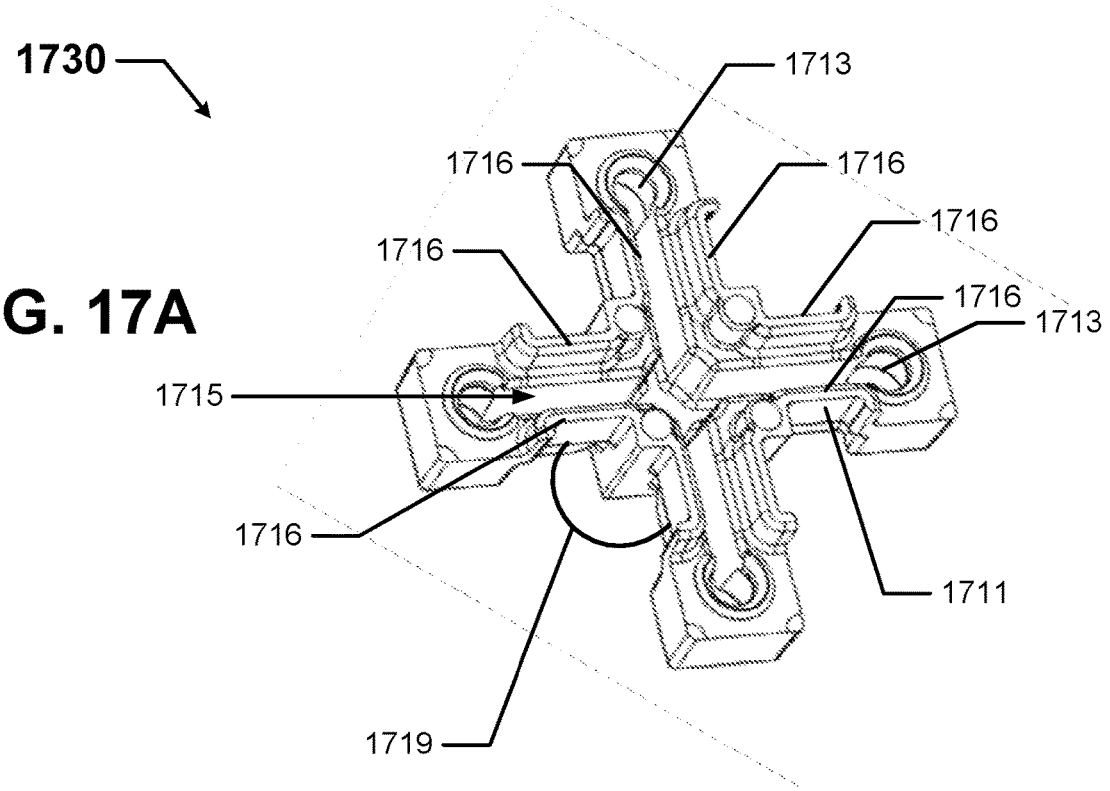
Figure 17B:
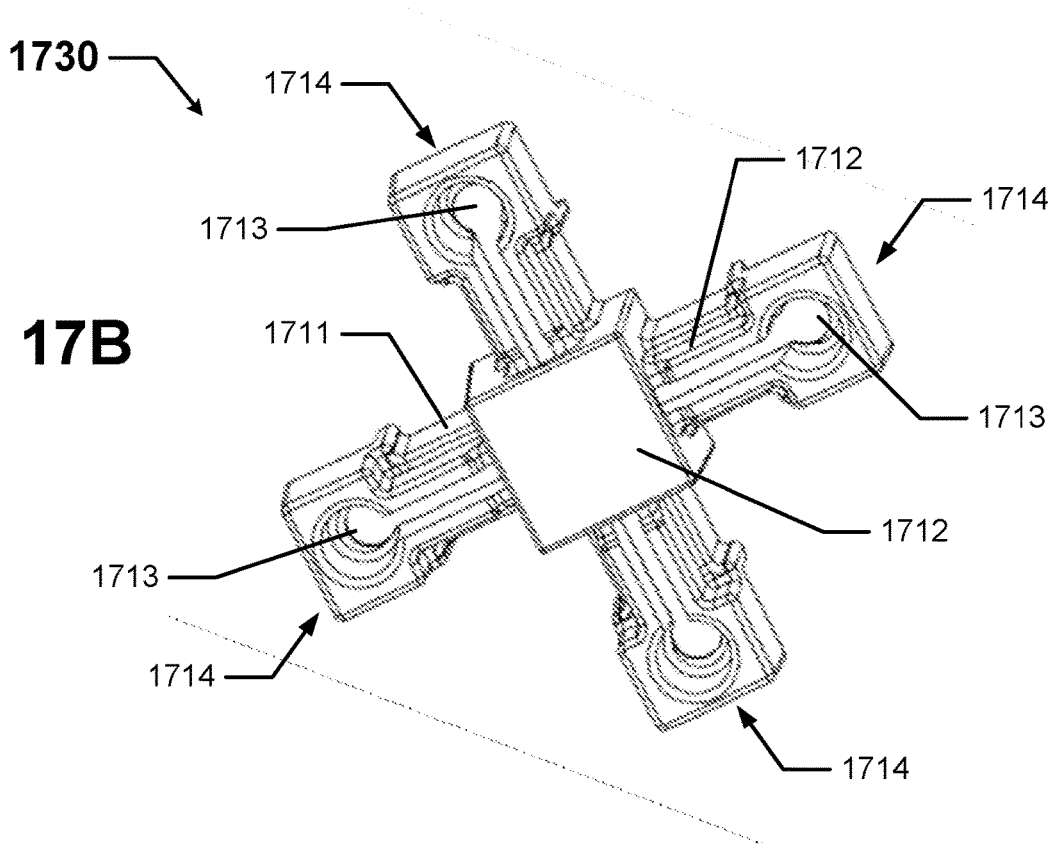
Figure 18:
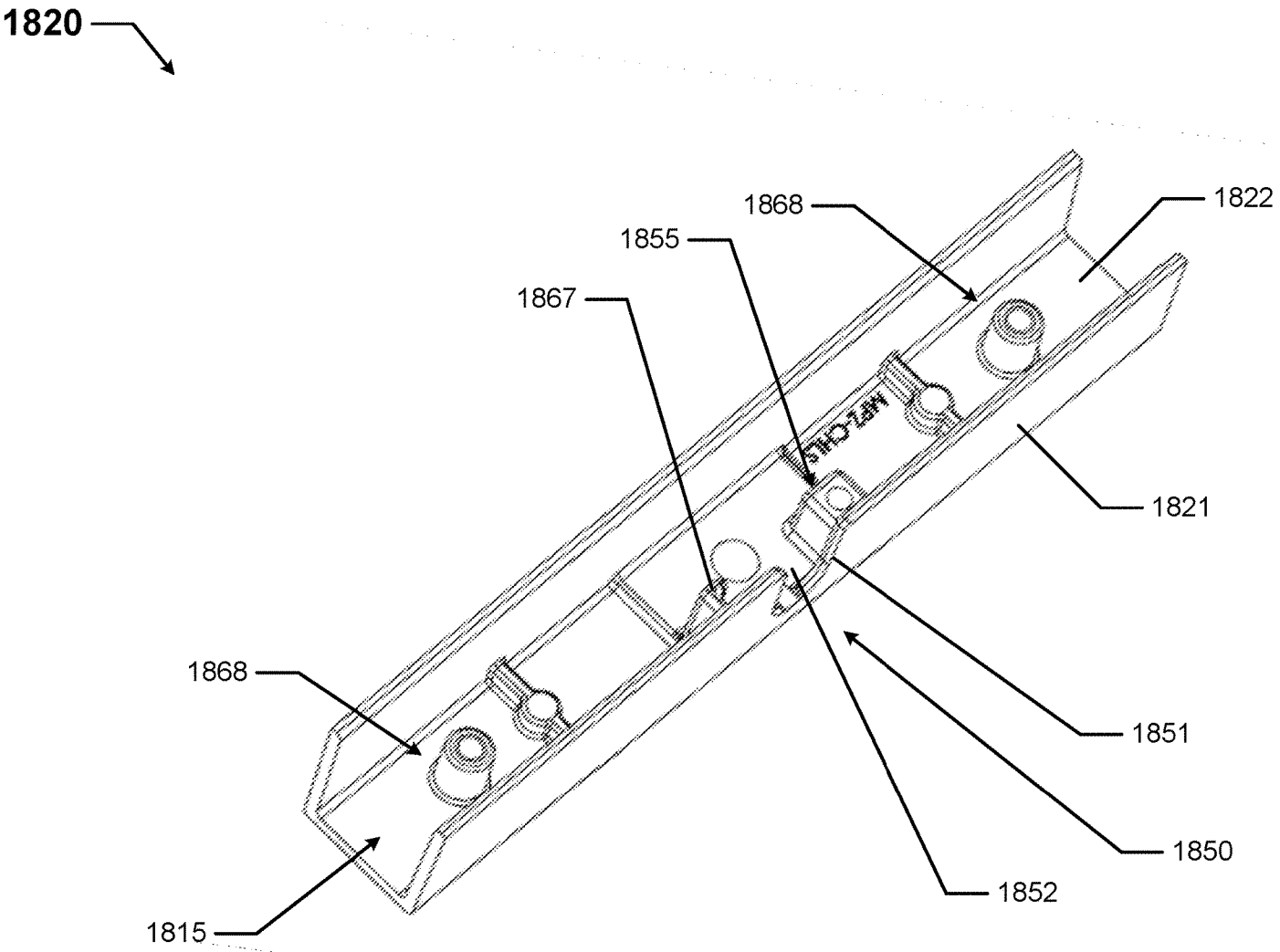

FIGS. 15A-18 show alternative components of a modular frame in accordance with certain example embodiments. Specifically, FIG. 15A shows a top-side-front perspective view of an alternative corner junction 1510. FIG. 15B shows a bottom-side-front perspective view of the corner junction 1510. FIG. 16A shows a top-side-front perspective view of an alternative T junction 1640. FIG. 16B shows a bottom-side-front perspective view of the T junction 1640. FIG. 17A shows a top-side-front perspective view of an alternative cross junction 1730. FIG. 17B shows a bottom-side-front perspective view of the cross junction 1730. FIG. 18 shows a top-side-front perspective view of an alternative linear section 1820.

Referring to FIGS. 1-18, the components of FIGS. 15A-18 are substantially similar to the corresponding components shown and described above with respect to FIGS. 2-5. For example, the components of FIGS. 15A-18 are designed to couple to each other in a modular fashion to create any of a number of configurations for a frame of a light fixture. The particular configuration of these components differ in some ways from the corresponding components of FIGS. 2-5, as described below.

Figure 15B:
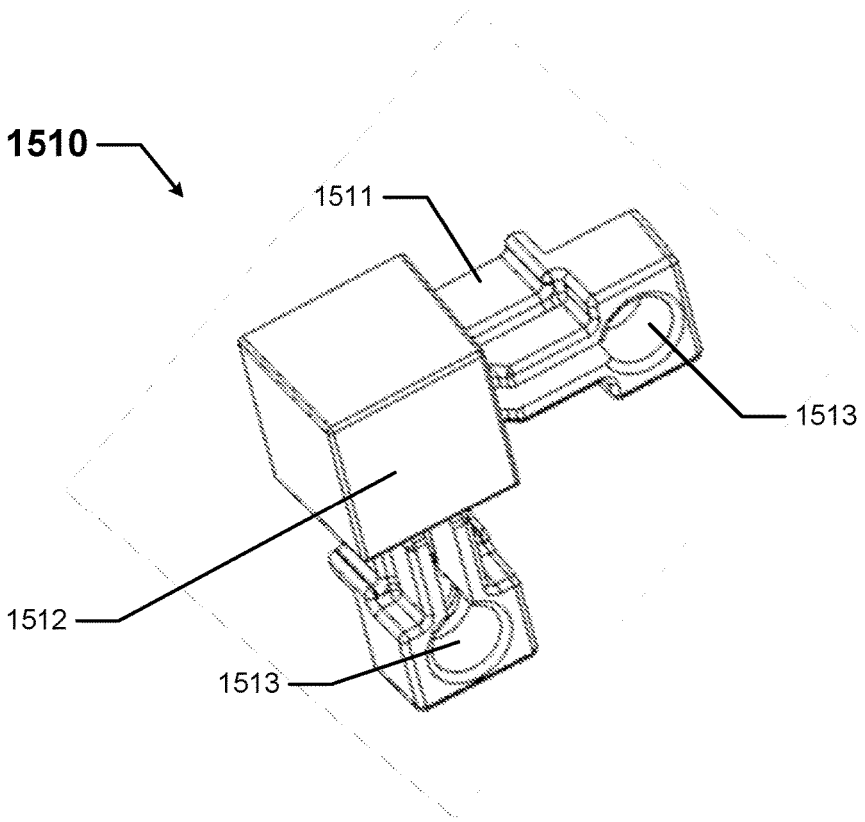

The corner junction 1510 of FIGS. 15A and 15B includes two arms 1514 that form an angle 1519 (e.g., 90° (as in this case), 75°) therebetween. Each arm 1514 has two side surfaces 1511 adjacent to the bottom surface 1512. The side surfaces 1511 can be substantially parallel with each other and substantially perpendicular with the top surface 1512. A channel 1515 can be formed between the side surfaces 1511 of each arm 1514. The bottom surface 1512 and each of the side surfaces 1511 in this example are planar. Alternatively, the bottom surface 1512 and/or the side surfaces 1511 can have any of a number of other configurations, either individually or with respect to each other.

Each of the arms 1514 of the corner junction 1510 are designed to fit within a side of a linear section 1820. As a result, the side surfaces 1511 can be shorter than the portion of the corner junction 1510 that includes the bottom surface 1512. Each arm 1514 of the corner junction 1510 includes one or more coupling features 1513 to allow the corner junction 1510 to couple to an adjacent component (e.g., a linear section 1820) of a frame for a light fixture. In this case, the coupling feature 1513 is an aperture that traverses the height of the arm 1514 toward a distal end of the arm 1514.

The aperture is designed to receive a fastening device (e.g., a screw), which is also a type of coupling feature.

In some cases, a protrusion 1517 can be disposed on one or more of the side surfaces 1511, such as in this case where the two arms 1514 meet. This protrusion 1517 can serve as a stop against which another component (e.g., a linear section 1820) of a frame can abut. In certain example embodiments, as shown in FIG. 15A, the corner junction 1510 can include one or more extensions 1516 that extend upward from part of the outer edge of an arm 1514 and/or another part of the corner junction 1510. These extensions 1516 can be configured (e.g., height, width) to provide a substantially seamless transition between the corner junction 1510 and any adjoining components (e.g., linear section 1820). In this case, the height of the extensions 1516 is designed to become planar with the top edge of the linear section 1820 when the corner junction 1510 is coupled to the linear section 1820.

Any wiring that needs to pass through the corner junction 1510 can be disposed within the channels 1515, formed atop the coupling features 1513 and between the extensions 1516. In such a case, the extensions 1516 can be flared outward and terminate short of the coupling features 1513, allowing any wiring to be fed around the coupling features 1513 and avoid getting pinched.

The T junction 1640 of FIGS. 16A and 16B includes three arms 1614 that form an angle 1619 (e.g., 90° (as in this case), 75°) between the middle arm 1614 and each adjacent arm 1614. Each arm 1614 has two side surfaces 1611 adjacent to the bottom surface 1612. The side surfaces 1611 can be substantially parallel with each other and substantially perpendicular with the top surface 1612. A channel 1615 can be formed between the side surfaces 1611 of each arm 1614. The bottom surface 1612 and each of the side surfaces 1611 in this example are planar. Alternatively, the bottom surface 1612 and/or the side surfaces 1611 can have any of a number of other configurations, either individually or with respect to each other.

Each of the arms 1614 of the T junction 1640 are designed to fit within a side of a linear section 1820. As a result, the side surfaces 1611 can be shorter than the portion of the T junction 1640 that includes the bottom surface 1612. Each arm 1614 of the T junction 1640 includes one or more coupling features 1613 to allow the T junction 1640 to couple to an adjacent component (e.g., a linear section 1820) of a frame for a light fixture. In this case, the coupling feature 1613 is an aperture that traverses the height of the arm 1614 toward a distal end of the arm 1614. The aperture is designed to receive a fastening device (e.g., a screw), which is also a type of coupling feature.

In some cases, a protrusion 1617 can be disposed on one or more of the side surfaces 1611, such as in this case where the two arms 1614 meet. This protrusion 1617 can serve as a stop against which another component (e.g., a linear section 1820) of a frame can abut. In certain example embodiments, as shown in FIG. 16A, the T junction 1640 can include one or more extensions 1616 that extend upward from part of the outer edge of an arm 1614 and/or another part of the T junction 1640. These extensions 1616 can be configured (e.g., height, width) to provide a substantially seamless transition between the T junction 1640 and any adjoining components (e.g., linear section 1820). In this case, the height of the extensions 1616 is designed to become planar with the top edge of the linear section 1820 when the T junction 1640 is coupled to the linear section 1820.

Any wiring that needs to pass through the T junction 1640 can be disposed within the channels 1615, formed atop the coupling features 1613 and between the extensions 1616. In such a case, the extensions 1616 can be flared outward and terminate short of the coupling features 1613, allowing any wiring to be fed around the coupling features 1613 and avoid getting pinched.

The cross junction 1730 of FIGS. 17A and 17B includes four arms 1714 that form an angle 1719 (e.g., 90° (as in this case), 75°) between each set of adjacent arms 1714. Each arm 1714 has two side surfaces 1711 adjacent to the bottom surface 1712. The side surfaces 1711 can be substantially parallel with each other and substantially perpendicular with the top surface 1712. A channel 1715 can be formed between the side surfaces 1711 of each arm 1714. The bottom surface 1712 and the each of the side surfaces 1711 in this example are planar. Alternatively, the bottom surface 1712 and/or the side surfaces 1711 can have any of a number of other configurations, either individually or with respect to each other.

Each of the arms 1714 of the cross junction 1730 are designed to fit within a side of a linear section 1820. As a result, the side surfaces 1711 can be shorter than the portion of the cross junction 1730 that includes the bottom surface 1712. Each arm 1714 of the cross junction 1730 includes one or more coupling features 1713 to allow the cross junction 1730 to couple to an adjacent component (e.g., a linear section 1820) of a frame for a light fixture. In this case, the coupling feature 1713 is an aperture that traverses the height of the arm 1714 toward a distal end of the arm 1714. The aperture is designed to receive a fastening device (e.g., a screw), which is also a type of coupling feature.

In some cases, a protrusion 1717 can be disposed on one or more of the side surfaces 1711, such as in this case where the two arms 1714 meet. This protrusion 1717 can serve as a stop against which another component (e.g., a linear section 1820) of a frame can abut. In certain example embodiments, as shown in FIG. 17A, the cross junction 1730 can include one or more extensions 1716 that extend upward from part of the outer edge of an arm 1714 and/or another part of the cross junction 1730. These extensions 1716 can be configured (e.g., height, width) to provide a substantially seamless transition between the cross junction 1730 and any adjoining components (e.g., linear section 1820). In this case, the height of the extensions 1716 is designed to become planar with the top edge of the linear section 1820 when the cross junction 1730 is coupled to the linear section 1820.

Any wiring that needs to pass through the cross junction 1730 can be disposed within the channels 1715, formed atop the coupling features 1713 and between the extensions 1716. In such a case, the extensions 1716 can be flared outward and terminate short of the coupling features 1713, allowing any wiring to be fed around the coupling features 1713 and avoid getting pinched.

The linear section 1820 of FIG. 18 has a bottom surface 1822 and two side surfaces 1821 that form a U-shaped channel 1815 that traverses the length of the linear section 1820. Each end of the linear section 1820 can be equivalent to an arm (e.g., arm 1514) of an adjoining component (e.g., corner junction 1510). The linear section 1820 can include one or more of a number of coupling features that allow the linear section 1820 to couple with another component (e.g., corner junction 1510, T junction 1640, cross junction 1730) of the frame.

For example, as shown in FIG. 18, the channel 1815 can have disposed therein one or more (in this case, two)

coupling features 1868. These coupling features 1868 in this case are bosses with apertures traversing therethrough that extend upward from the bottom surface 1822. The coupling features 1868 in this example are disposed proximate to each end of the linear section 1820. The coupling features 1868 can have a height that is less than the height of the side surfaces 1821 of the linear section 1820. Further, the location, shape, and size of each coupling features 1868 can be configured to complement a corresponding coupling feature (e.g., coupling feature 1513) of an adjacent component (e.g., corner junction 1510) so that the linear section 1820 and the adjacent component can couple, directly or indirectly, to each other.

As another example, as shown in FIG. 18, the linear section 1820 can have one or more (in this case, two) additional coupling features 1855 disposed within the channel 1815. In this case, each coupling feature 1855 is located adjacent to a coupling feature 1850 (discussed below), which is disposed in a side wall 1821. Each coupling feature 1855 in this case are bosses with apertures traversing therethrough that extend upward from the bottom surface 1822. The coupling features 1855 can have a height that is less than the height of the side surfaces 1821 of the linear section 1820. Further, the location, shape, and size of each coupling feature 1855 can be configured to complement a corresponding the coupling features 1982 and 1984 of the tensioning mechanism 1985, discussed below with respect to FIGS. 19A and 19B, so that the linear section 1820 and the tensioning mechanism 1985 can couple, directly or indirectly, to each other.

In certain example embodiments, complementing each coupling feature 1855 of a linear section 1820 can be one or more additional coupling features 1867 disposed within the channel 1815. In such a case, each coupling feature 1867 can located adjacent to a coupling feature 1850, but on the opposite side of the coupling feature 1850 relative to the complementary coupling feature 1855. Each coupling feature 1867 in this case are protrusions that extend upward from the bottom surface 1822. The coupling features 1867 can have a height that is less than the height of the side surfaces 1821 of the linear section 1820. Further, the location, shape, and size of each coupling feature 1867 can be configured to complement a body 1986 of a tensioning mechanism 1985, discussed below with respect to FIGS. 19A and 19B, so that the linear section 1820 and the tensioning mechanism 1985 can couple, directly or indirectly, to each other.

The linear section 1820 can also include one or more coupling features for allowing the linear section 1820 to couple to a light module subassembly (e.g., light module subassembly 670) or a light module assembly (e.g., light module assembly 790). For example, as shown in FIG. 18, the linear section 1820 can include a coupling feature 1850 disposed in each side surface 1821. In this case, the coupling feature 1850 is a slot 1852, defined by a slot surface 1851, that traverses the thickness of the side surface 1821 and extends from the top of the side surface 1821 to some point toward, but not reaching, the bottom of the side surface 1821. The width of the coupling feature 550 (and so the width of a side wall 1821) can be wide enough to couple to (e.g., receive) a complementary coupling feature of a light module subassembly or a light module assembly. An example of such a complementary coupling feature of a light module assembly or light module assembly is discussed above with respect to FIGS. 6A-7B.

In certain example embodiments, the coupling feature 1850 of the linear section 1820 can be configured to transfer electrical signals (e.g., power signals, control signals, communication signals, data signals) directly to the component of the light fixture that couples thereto, without the use of electrical conductors (e.g., wires, cables). In such a case, the linear section 1820 and one or more of the other components (e.g., corner junction 1510, a T junction 1640, a cross junction 1730) of a frame can be configured to have a busbar-type of system disposed within their respective channels (e.g., channel 1815, channel 1515).

Figure 19A:
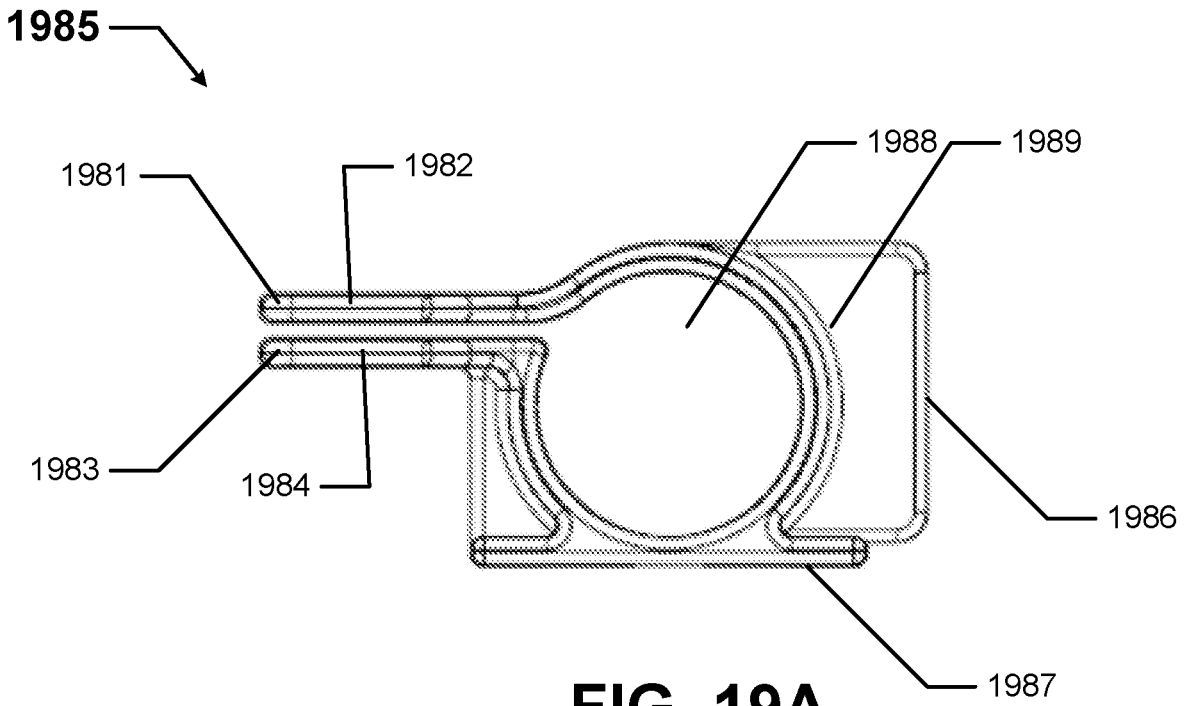
FIGS. 19A and 19B show a tensioning mechanism in accordance with certain example embodiments.
Figure 19B:
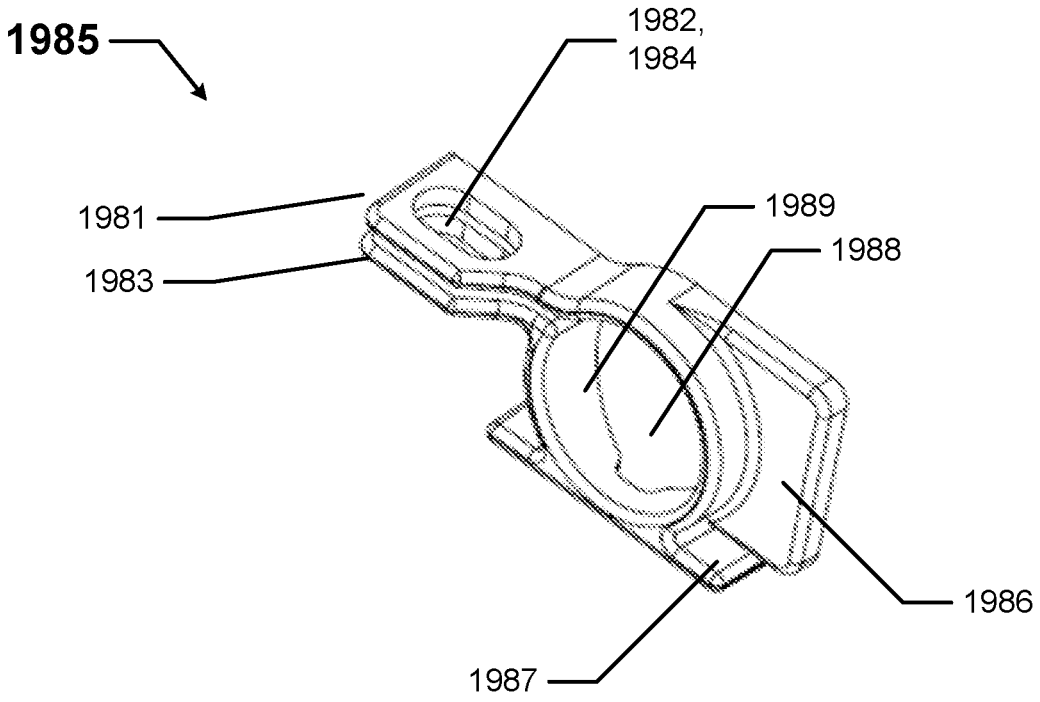

FIGS. 19A and 19B show a tensioning mechanism 1985 in accordance with certain example embodiments. Specifically, FIG. 19A shows a cross-sectional front view of the tensioning mechanism 1985. FIG. 19B shows a top-side-front perspective view of the tensioning mechanism 1985. The tensioning mechanism 1985 of FIGS. 19A and 19B is an alternative way (e.g., an alternative to the sealing member 680 discussed above) for a light module subassembly (e.g., light module subassembly 670) and/or a light module assembly (e.g., light module assembly 790) to become movably coupled to an example frame.

Referring to FIGS. 1-19B, the tensioning mechanism 1985 can include one or more of a number of features and/or components. For example, in this case, the tensioning mechanism 1985 includes a body 1986, a base 1987, an inner surface 1989 (also called a boss 1989) that forms an aperture 1988, a top extension 1981 having an aperture 1982, and a bottom extension 1983 that has an aperture 1984. The tensioning mechanism 1985 forms a type of Gimbal ring. The body 1986 is adjacent to and extends from the base 1987, both of which are configured (e.g., shape, height, length, width) to couple to (e.g., abut against, slide into) coupling feature 1867 of a linear section 1820.

The aperture 1988 formed by the inner surface 1989 has a shape and size that is substantially the same as the shape and size of a coupling feature (e.g., coupling feature 678) of a light module subassembly (e.g., light module subassembly 670) and/or a coupling feature (e.g., coupling feature 778) of a light module assembly (e.g., light module assembly 790). The top extension 1981 and the bottom extension 1983 (also sometimes called a tensioning clip) are configured to align so that aperture 1982 that traverses top extension 1981 and aperture 1984 that traverses bottom extension 1983 align with each other so that both apertures 1982 and 1984 can receive a coupling feature (e.g., a screw), as shown in FIGS. 20A-20C below.

When a coupling feature is applied to aperture 1982 and aperture 1984, the shape and/or size of the inner surface 1989 (and so also the shape and/or size of the aperture 1988 formed by the inner surface 1989) can be adjusted. When a coupling feature (e.g., coupling feature 678) of a light module subassembly (e.g., light module subassembly 670) or a coupling feature (e.g., coupling feature 778) of a light module assembly (e.g., light module assembly 790) is disposed in the aperture 1988, the amount of friction applied by the inner surface 1989 of the tensioning mechanism 1985 to that coupling feature can be adjusted, making it easier or more difficult to move the corresponding light module subassembly or a coupling feature (e.g., coupling feature 778) light module assembly relative to the tensioning mechanism 1985 (and so also the corresponding frame in which the tensioning mechanism 1985 is disposed).

Figure 20A:
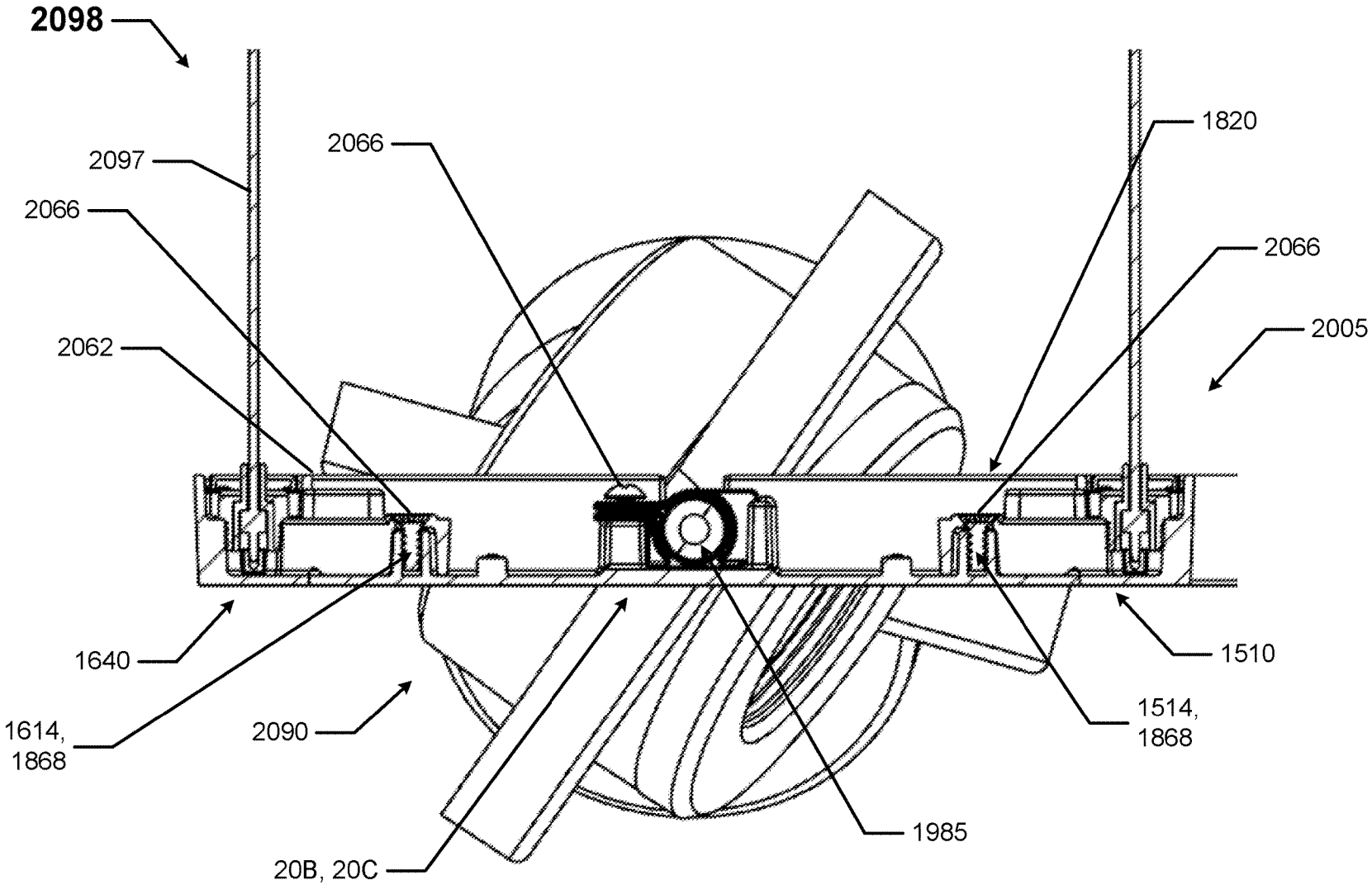
FIGS. 20A-20C show a subassembly that includes the components of FIGS. 15A-18 and the tensioning mechanism of FIGS. 19A and 19B.
Figure 20B:
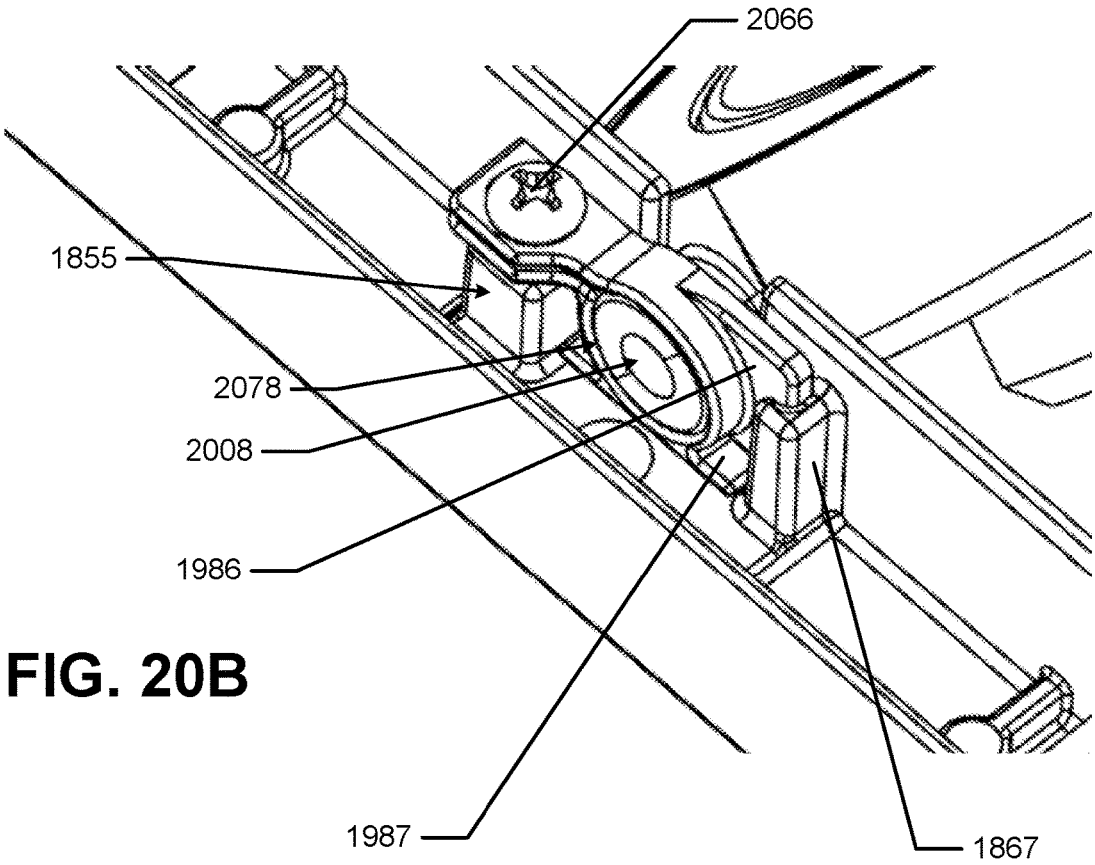
Figure 20C:
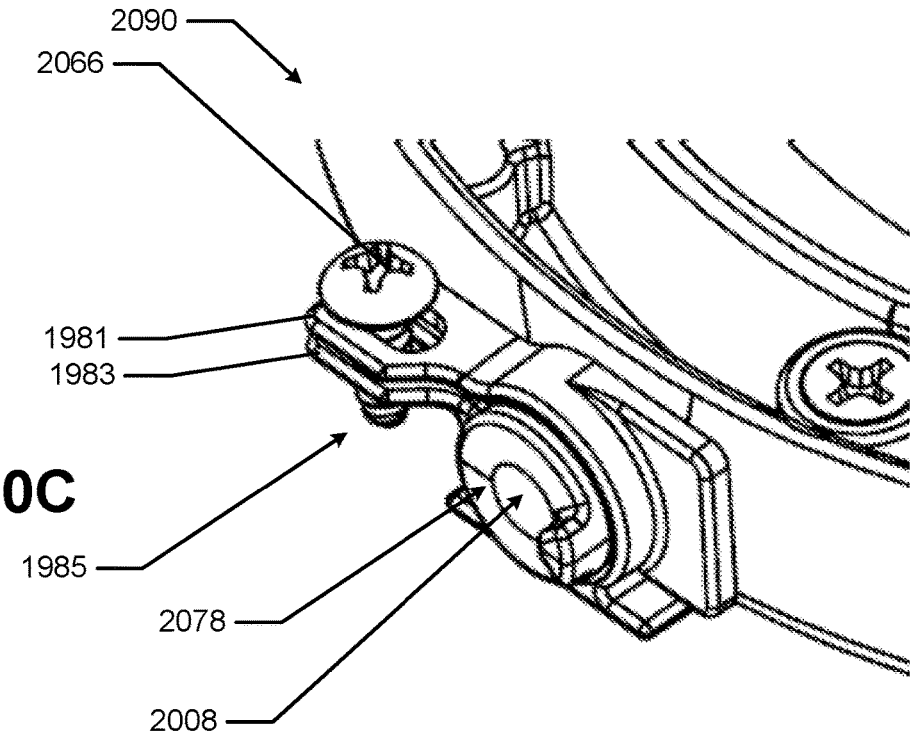

FIGS. 20A-20C show a subassembly 2098 that includes the components of FIGS. 15A-18 and the tensioning mechanism 1985 of FIGS. 19A and 19B. Specifically, FIG. 20A shows a cross-sectional front view of the subassembly 2098. FIG. 20B shows a semi-transparent cross-sectional top-front-side perspective view of a portion of the subassembly

2098. FIG. 20C shows a top-front-side perspective view of a portion of the subassembly 2098. Referring to FIGS. 1-20C, the components of FIGS. 15A-18 (specifically, in this subassembly 2098, a linear section 1820, a corner junction 1510, and a T junction 1640) form part of a frame 2005 of a light fixture.

Specifically, coupling feature 1614 of the T junction 1640 is disposed over coupling feature 1868 of the linear section 1820, and an independent coupling feature 2066 (in this case, a screw) is used to engage both coupling feature 1614 and coupling feature 1868, securely coupling the T junction 1640 to the linear section 1820. Similarly, coupling feature 1514 of the corner junction 1510 is disposed over another coupling feature 1868 of the linear section 1820, and an independent coupling feature 2066 (in this case, another screw) is used to engage both coupling feature 1514 and coupling feature 1868, securely coupling the corner junction 1510 to the linear section 1820.

FIGS. 20A-20C also shows the tensioning mechanism 1985 coupled to the linear section 1820, In this case, as detailed in FIG. 20B, the base 1987 and the body 1986 are coupled to (abut against) coupling feature 1867 of the linear section 1820. Also, the aperture 1982 of the top extension 1981 and the aperture 1984 of the bottom extension 1983 of the tensioning mechanism 1985 are aligned with the aperture that traverses the coupling feature 1855 if the linear section 1820, and an independent coupling feature 2066 (in this case, a screw) is used to secure the top extension 1981 and the bottom extension 1983 of the tensioning mechanism 1985 to the coupling feature 1855 of the linear section 1820.

FIGS. 20A-20C also shows the tensioning mechanism 1985 coupled to the coupling feature 2078 of a light module assembly 2090. In this case, as detailed in FIGS. 20B and 20C, the inner surface 1989 of the tensioning mechanism 1985 is wrapped around the outer surface of the coupling feature 2078 of the light module assembly 2090. As the coupling feature 2066 is tightened relative to the top extension 1981, the bottom extension 1983, and the coupling feature 1855, the inner surface of the tensioning mechanism 1985 applies more friction against the outer surface of the coupling feature 2078 of the light module assembly 2090, making it more difficult to move the light module assembly 2090 relative to the frame 2005. Conversely, as the coupling feature 2066 is loosened relative to the top extension 1981, the bottom extension 1983, and the coupling feature 1855, the inner surface of the tensioning mechanism 1985 applies less friction against the outer surface of the coupling feature 2078 of the light module assembly 2090, making it easier to move the light module assembly 2090 relative to the frame 2005.

It should be noted that FIG. 20B is semi-transparent because the one or more covers 2062 that are disposed atop the frame 2005 (in this case, the linear section 1820, the corner junction 1510, and the T junction 1640) is transparent in FIG. 20B, but is shown in solid form in FIG. 20A. A cover 2062 can include one or more coupling features (e.g., apertures, clips, slots) that allow the cover 2062 to become removably coupled, directly or indirectly, to one or more components of the frame 2005.

In one or more example embodiments, example housings and modular frames can be used with light fixtures to allow a user to easily configure a light fixture according to the user's preference, to fit within a certain space, to direct light in a certain area, and/or for any other reason or purpose. Example housings and modular frames can allow a light fixture to comply with any of a number of applicable codes and/or standards (e.g., UL standards). Using example embodiments described herein can improve safety, maintenance, costs, customer satisfaction, ease of use, and operating efficiency.

Accordingly, many modifications and other embodiments set forth herein will come to mind to one skilled in the art to which example embodiments pertain having the benefit of the teachings presented in the foregoing descriptions and the associated drawings. Therefore, it is to be understood that example embodiments are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A frame for a light fixture comprising:

a plurality of linear sections, wherein each linear section of the plurality of linear sections comprises a channel that is configured to have disposed therein at least one electrical conductor;

at least one torsion hinge; and a plurality of junctions coupled to the plurality of linear sections, wherein each junction of the plurality of junctions is detachably coupled to and disposed within the channel of two or more linear sections of the plurality of linear sections, wherein the plurality of junctions and the plurality of linear sections form a planar front surface, and wherein at least a pair of the plurality of linear sections comprises at least one light module assembly coupling feature that is configured to couple to at least one light module assembly, wherein the at least a pair of the plurality of linear sections are positioned on opposing sides of the at least one light module assembly, wherein the at least one torsion spring is disposed within the channel adjacent to the at least one light module assembly coupling feature, wherein the at least one torsion spring is configured to prevent the at least one light module assembly from moving unless a minimum amount of rotational force is applied to the at least one light module assembly.

2. The frame of claim 1, wherein the plurality of junctions comprises at least one corner junction.

3. The frame of claim 1, wherein the plurality of junctions comprises at least one T junction.

4. The frame of claim 1, wherein the plurality of junctions comprises at least one cross junction.

5. The frame of claim 1, wherein the at least one light module assembly coupling feature comprises a slot disposed in a side wall of the linear section.

6. The frame of claim 1, wherein each torsion hinge is coupled to an inner surface of a linear section.

7. The frame of claim 6, wherein the inner surface of the linear section comprises at least one protrusion into which the torsion hinge is disposed.

8. The frame of claim 6, wherein the torsion hinge is coupled to the inner surface of the linear section using a fastening device.

9. The frame of claim 1, wherein the at least one torsion hinge comprises a sealing member.

10. The frame of claim 1, wherein the plurality of linear sections and the plurality of junctions are coupled to each other and decoupled from each other without use of tools.

11. The frame of claim 1, further comprising a plurality of covers detachably disposed over a top of the plurality of linear sections.

12. The frame of claim 1, wherein the plurality of linear sections and the plurality of junctions form at least one square, wherein each at least one square is configured to receive the at least one light module assembly.

13. The frame of claim 1, wherein the plurality of linear sections and the plurality of junctions are configured to receive at least one support member that is substantially invisible.

14. The frame of claim 13, wherein the at least one support member provides electrical power to the at least one electrical conductor.

15. A light module assembly comprising:

a housing comprising:

a housing body that encloses at least a portion of a light module;

at least one first housing extension disposed on and extending away from the housing body, wherein the at least one first housing extension is configured to couple to a frame, wherein the at least one first housing extension comprises two halves joined together to form a cavity that is configured to encapsulate a means of electrical signal conveyance between the light module and the frame; and an auxiliary section comprising:

an auxiliary section body;

at least one housing coupling feature disposed on the auxiliary section body, wherein the at least one housing coupling feature couples to the at least one first extension of the housing, and wherein the at least one housing coupling feature provides the means of electrical conveyance to the at least one first extension; and at least one second extension disposed on the auxiliary section body, wherein the at least one second extension is configured to couple to the frame, wherein the at least one second extension is further configured to receive the means of electrical signal conveyance from the frame, wherein the at least one first extension and the at least one second extension move independently of each other when sufficient rotational force is applied to overcome a friction resistance provided by at least one torsion hinge disposed within the frame.

16. The light module assembly of claim 15, wherein the housing body comprises a plurality of pieces that mechanically couple to each other without use of tools.

17. The light module assembly of claim 15, wherein the at least one first extension allows a user to adjust a position of the housing relative to the frame without tightening or loosening any components.

18. The light module assembly of claim 15, wherein the at least one first extension and the at least one second extension are offset from each other by 90° along a length of the auxiliary section body.

* * * * *